US010080472B2

(12) United States Patent
Conrad

(10) Patent No.: US 10,080,472 B2
(45) Date of Patent: Sep. 25, 2018

(54) HAND CARRIABLE SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton, Ontario (CA)

( * ) Notice: Subject to any disclaimer, the term of this patent is extended or adjusted under 35 U.S.C. 154(b) by 0 days.

(21) Appl. No.: 15/051,272

(22) Filed: Feb. 23, 2016

(65) Prior Publication Data

US 2016/0213211 A1 Jul. 28, 2016

Related U.S. Application Data

(63) Continuation of application No. 14/994,495, filed on Jan. 13, 2016, which is a continuation of application (Continued)

(51) Int. Cl.

| | |
|---|---|
| ***A47L 5/24*** | (2006.01) |
| ***A47L 5/22*** | (2006.01) |
| ***A47L 9/12*** | (2006.01) |
| ***A47L 9/16*** | (2006.01) |
| ***A47L 9/22*** | (2006.01) |

(52) U.S. Cl.

CPC ..... *A47L 5/24* (2013.01); *A47L 5/225* (2013.01); *A47L 9/122* (2013.01); *A47L 9/16* (2013.01); *A47L 9/1608* (2013.01); *A47L 9/1683* (2013.01); *A47L 9/22* (2013.01)

(58) Field of Classification Search

CPC ..... A47L 5/24; A47L 9/1683; A47L 5/225; A47L 9/122; A47L 9/16; A47L 9/1608; A47L 9/22

See application file for complete search history.

(56) References Cited

U.S. PATENT DOCUMENTS

| | | | |
|---|---|---|---|
| 911,258 | A | 2/1909 | Neumann |
| 1,600,762 | A | 9/1926 | Hawley |

(Continued)

FOREIGN PATENT DOCUMENTS

| | | |
|---|---|---|
| AU | 112778 | 4/1940 |
| CA | 1077412 A1 | 5/1980 |

(Continued)

OTHER PUBLICATIONS

Extended European Search Report received on the corresponding European Patent Application No. 11157642.7-2316, dated May 8, 2012.

(Continued)

*Primary Examiner* — Christopher M Koehler
*Assistant Examiner* — Joel Crandall
(74) *Attorney, Agent, or Firm* — Philip C. Mendes da Costa; Bereskin & Parr LLP/S.E.N.C.R.L., s.r.l.

(57) ABSTRACT

A hand vacuum cleaner comprises an air flow passage extending from a dirty air inlet to a clean air outlet. A suction motor is positioned in the air flow path. At least one air treatment member, which is optionally a cyclone chamber, is positioned in the air flow path. A pre-motor filter is positioned in a pre-motor filter housing having an openable cover and the air treatment member air outlet axis extends through the pre-motor filter housing.

25 Claims, 20 Drawing Sheets

Related U.S. Application Data

No. 13/039,376, filed on Mar. 3, 2011, now Pat. No. 9,265,395, which is a continuation-in-part of application No. 12/722,705, filed on Mar. 12, 2010, now Pat. No. 8,578,555.

(56) References Cited

U.S. PATENT DOCUMENTS 1,797,812 A 3/1931 Waring
1,898,608 A 2/1933 Alexander
1,937,765 A 12/1933 Leathers
2,015,464 A 9/1935 Saint-Jacques
2,152,114 A 3/1939 Van Tongeren
2,542,634 A 2/1951 Davis et al.
2,678,110 A 5/1954 Madsen
2,731,102 A 1/1956 James
2,811,219 A 10/1957 Wenzl
2,846,024 A 8/1958 Bremi
2,913,111 A 11/1959 Rogers
2,917,131 A 12/1959 Evans
2,937,713 A 5/1960 Stephenson et al.
2,942,691 A 6/1960 Dillon
2,942,692 A 6/1960 Benz
2,946,451 A 7/1960 Culleton
2,952,330 A 9/1960 Winslow
2,981,369 A 4/1961 Yellott et al.
3,002,215 A 10/1961 MacFarland
3,032,954 A 5/1962 Racklyeft
3,085,221 A 4/1963 Kelly
3,130,157 A 4/1964 Kelsall et al.
3,200,568 A 8/1965 McNeil
3,204,772 A 9/1965 Ruxton
3,217,469 A 11/1965 Eckert
3,269,097 A 8/1966 German
3,320,727 A 5/1967 Farley et al.
3,372,532 A 3/1968 Campbell
3,426,513 A 2/1969 Kurt
3,498,068 A 3/1970 Tadayon
3,518,815 A 7/1970 Peterson et al.
3,530,649 A 9/1970 Porsch et al.
3,561,824 A 2/1971 Homan
3,582,616 A 6/1971 Wrob
3,675,401 A 7/1972 Cordes
3,684,093 A 8/1972 Kono
3,822,533 A 7/1974 Oranje
3,870,486 A * 3/1975 Eriksson ..... A47L 7/0019 55/309
3,877,902 A * 4/1975 Eriksson ..... A47L 5/365 55/337
3,933,450 A 1/1976 Percevaut
3,988,132 A 10/1976 Oranje
3,988,133 A 10/1976 Schady
4,097,381 A 6/1978 Ritzler
4,187,088 A 2/1980 Hodgson
4,218,805 A 8/1980 Brazier
4,236,903 A 12/1980 Malmsten
4,307,485 A 12/1981 Dessig
4,373,228 A 2/1983 Dyson
4,382,804 A 5/1983 Mellor
4,409,008 A 10/1983 Solymes
4,486,207 A 12/1984 Baillie
4,678,588 A 7/1987 Shortt
4,700,429 A 10/1987 Martin et al.
4,744,958 A 5/1988 Pircon
4,778,494 A 10/1988 Patterson
4,826,515 A 5/1989 Dyson
D303,173 S 8/1989 Miyamoto et al.
4,853,008 A 8/1989 Dyson
4,853,011 A 8/1989 Dyson
4,853,111 A 8/1989 MacArthur et al.
4,905,342 A 3/1990 Ataka
4,944,780 A 7/1990 Usmani
2,080,697 A 1/1992 Finke
5,078,761 A 1/1992 Dyson
5,090,976 A 2/1992 Dyson
5,129,125 A 7/1992 Gamou et al.
5,224,238 A 7/1993 Bartlett
5,230,722 A 7/1993 Yonkers
5,254,019 A 10/1993 Noschese
5,267,371 A 12/1993 Solerm et al.
5,309,601 A 5/1994 Hampton et al.
5,347,679 A 9/1994 Saunders et al.
5,481,780 A 1/1996 Daneshvar
5,599,365 A 2/1997 Alday et al.
D380,033 S 6/1997 Masterton et al.
5,755,096 A 5/1998 Holleyman
5,815,878 A 10/1998 Murakami et al.
5,858,038 A 1/1999 Dyson et al.
5,858,043 A 1/1999 Geise
5,893,938 A 4/1999 Dyson et al.
5,935,279 A 8/1999 Kilstrom
5,950,274 A 9/1999 Kilstrom
6,071,095 A 6/2000 Verkaar
6,071,321 A 6/2000 Trapp et al.
6,080,022 A 6/2000 Shaberman et al.
6,122,796 A 9/2000 Downham et al.
6,221,134 B1 4/2001 Conrad et al.
6,228,260 B1 5/2001 Conrad et al.
6,231,645 B1 5/2001 Conrad et al.
6,251,296 B1 6/2001 Conrad et al.
6,260,234 B1 7/2001 Wright et al.
6,341,404 B1 * 1/2002 Salo ..... A47L 5/28 15/350
6,345,408 B1 2/2002 Nagai et al.
6,406,505 B1 6/2002 Oh et al.
6,434,785 B1 8/2002 Vandenbelt et al.
6,440,197 B1 8/2002 Conrad et al.
6,531,066 B1 3/2003 Saunders et al.
6,553,612 B1 4/2003 Dyson et al.
6,553,613 B2 4/2003 Onishi et al.
6,560,818 B1 5/2003 Hasko
6,581,239 B1 6/2003 Dyson et al.
6,599,338 B2 7/2003 Oh et al.
6,599,350 B1 7/2003 Rockwell et al.
6,613,316 B2 9/2003 Sun et al.
6,623,539 B2 9/2003 Lee et al.
6,625,845 B2 9/2003 Matsumoto et al.
6,648,934 B2 11/2003 Choi et al.
6,712,868 B2 3/2004 Murphy et al.
6,746,500 B1 6/2004 Park et al.
6,782,583 B2 8/2004 Oh
6,782,585 B1 8/2004 Conrad et al.
6,818,036 B1 11/2004 Seaman
6,833,015 B2 12/2004 Oh et al.
6,868,578 B1 3/2005 Kasper
6,874,197 B1 4/2005 Conrad
6,896,719 B2 5/2005 Coates et al.
6,929,516 B2 8/2005 Brochu et al.
6,968,596 B2 11/2005 Oh et al.
6,976,885 B2 12/2005 Lord
7,160,346 B2 1/2007 Park
7,162,770 B2 1/2007 Davidshofer
7,175,682 B2 2/2007 Nakai et al.
7,198,656 B2 4/2007 Takemoto et al.
7,210,195 B2 5/2007 Howie et al.
7,222,393 B2 5/2007 Kaffenberger et al.
7,272,872 B2 9/2007 Choi
7,278,181 B2 10/2007 Harris et al.
7,341,611 B2 3/2008 Greene et al.
7,354,468 B2 4/2008 Arnold et al.
7,370,387 B2 5/2008 Walker et al.
7,377,007 B2 5/2008 Best
7,377,953 B2 5/2008 Oh
7,386,915 B2 6/2008 Blocker et al.
7,395,579 B2 7/2008 Oh
7,448,363 B1 11/2008 Rasmussen et al.
7,449,040 B2 11/2008 Conrad et al.
7,488,363 B2 2/2009 Jeong et al.
7,547,336 B2 * 6/2009 Fester ..... A47L 9/122 55/337
7,547,337 B2 6/2009 Oh
7,547,338 B2 6/2009 Kim et al.
7,588,616 B2 9/2009 Conrad et al.
7,597,730 B2 10/2009 Yoo et al.

(56) References Cited

U.S. PATENT DOCUMENTS 7,601,188 B2 10/2009 Hwang et al.
7,628,831 B2 12/2009 Gomiciaga-Pereda et al.
7,779,506 B2 5/2010 Kang et al.
7,740,676 B2 6/2010 Burnham et al.
7,770,256 B1 8/2010 Fester
7,774,898 B2 8/2010 Hong et al.
7,776,120 B2 8/2010 Conrad
7,803,207 B2 9/2010 Conrad
7,805,804 B2 10/2010 Loebig
7,811,349 B2 10/2010 Nguyen
7,867,308 B2 1/2011 Conrad
7,922,794 B2 4/2011 Morphey
7,931,716 B2 4/2011 Dakham
7,938,871 B2 5/2011 Lloyd
7,979,959 B2 7/2011 Courtney
8,021,453 B2 9/2011 Howes
8,062,398 B2 11/2011 Luo et al.
8,117,712 B2 2/2012 Dyson et al.
8,146,201 B2 4/2012 Conrad
8,152,877 B2 4/2012 Greene
8,156,609 B2 4/2012 Milne et al.
8,161,599 B2 4/2012 Griffith et al.
8,225,456 B2 7/2012 Hakan et al.
8,484,799 B2 7/2013 Conrad
8,677,558 B2 3/2014 Conrad
2001/0015132 A1 8/2001 Rohn et al.
2002/0011050 A1 1/2002 Hansen et al.
2002/0011053 A1 1/2002 Oh
2002/0062531 A1 5/2002 Oh
2002/0088208 A1 7/2002 Lukac et al.
2002/0112315 A1 8/2002 Conrad
2002/0134059 A1 9/2002 Oh
2002/0178535 A1 12/2002 Oh et al.
2002/0178698 A1 12/2002 Oh et al.
2002/0178699 A1 12/2002 Oh
2003/0046910 A1 3/2003 Lee
2003/0066273 A1 4/2003 Choi et al.
2003/0106180 A1 6/2003 Tsen
2003/0159238 A1 8/2003 Oh
2003/0159411 A1 8/2003 Hansen et al.
2003/0200736 A1 10/2003 Ni
2004/0010885 A1 1/2004 Hitzelberger et al.
2004/0025285 A1 2/2004 McCormick et al.
2004/0088816 A1 5/2004 Shimizu et al.
2004/0216263 A1 11/2004 Best et al.
2004/0216264 A1 11/2004 Shaver et al.
2005/0081321 A1 4/2005 Milligan et al.
2005/0115409 A1 6/2005 Conrad
2005/0132528 A1 6/2005 Yau
2005/0132529 A1 6/2005 Davidshofer
2005/0138763 A1 6/2005 Tanner et al.
2005/0198769 A1 9/2005 Lee et al.
2005/0198770 A1 9/2005 Jung et al.
2005/0252179 A1 11/2005 Oh et al.
2006/0016042 A1* 1/2006 Bruneau ..... A47L 9/122 15/314
2006/0037172 A1 2/2006 Choi
2006/0042206 A1 3/2006 Arnold et al.
2006/0090290 A1 5/2006 Lau
2006/0123590 A1 6/2006 Fester et al.
2006/0137304 A1 6/2006 Jeong et al.
2006/0137306 A1 6/2006 Jeong et al.
2006/0137309 A1 6/2006 Jeong et al.
2006/0137314 A1 6/2006 Conrad et al.
2006/0156508 A1 7/2006 Khalil
2006/0162298 A1 7/2006 Oh et al.
2006/0162299 A1 7/2006 North
2006/0168922 A1 8/2006 Oh
2006/0168923 A1 8/2006 Lee et al.
2006/0207055 A1 9/2006 Ivarsson et al.
2006/0207231 A1 9/2006 Arnold
2006/0230715 A1 10/2006 Oh et al.
2006/0230723 A1 10/2006 Kim et al.
2006/0230724 A1 10/2006 Han et al.
2006/0236663 A1 10/2006 Oh
2006/0277712 A1* 12/2006 Kim ..... A47L 9/122 15/353
2006/0278081 A1 12/2006 Han et al.
2007/0067944 A1 3/2007 Kitamura
2007/0077810 A1 4/2007 Gogel
2007/0079473 A1 4/2007 Min
2007/0079585 A1 4/2007 Oh et al.
2007/0095028 A1 5/2007 Kim
2007/0095029 A1 5/2007 Min
2007/0209334 A1 9/2007 Conrad
2007/0209335 A1 9/2007 Conrad
2007/0271724 A1 11/2007 Hakan et al.
2007/0289089 A1 12/2007 Yacobi
2007/0289266 A1 12/2007 Oh
2007/0289267 A1* 12/2007 Makarov ..... A47L 5/28 55/345
2008/0040883 A1 2/2008 Beskow et al.
2008/0047091 A1 2/2008 Nguyen
2008/0134460 A1 6/2008 Conrad
2008/0134462 A1 6/2008 Jansen et al.
2008/0172821 A1 7/2008 Kang et al.
2008/0178416 A1 7/2008 Conrad
2008/0178418 A1 7/2008 Conrad
2008/0178420 A1 7/2008 Conrad
2008/0190080 A1 8/2008 Oh et al.
2008/0196194 A1 8/2008 Conrad
2008/0196745 A1 8/2008 Conrad
2008/0216282 A1 9/2008 Conrad
2008/0256744 A1 10/2008 Rowntreer et al.
2008/0263813 A1* 10/2008 Han ..... A47L 5/225 15/334
2008/0301903 A1 12/2008 Cunningham et al.
2009/0056060 A1* 3/2009 Han ..... A47L 5/12 15/349
2009/0100633 A1 4/2009 Bates et al.
2009/0113659 A1 5/2009 Jeon
2009/0144932 A1 6/2009 Yoo
2009/0165431 A1 7/2009 Oh
2009/0205160 A1 8/2009 Conrad
2009/0205161 A1 8/2009 Conrad
2009/0205298 A1 8/2009 Hyun et al.
2009/0209666 A1 8/2009 Hellberg et al.
2009/0265877 A1 10/2009 Dyson et al.
2009/0282639 A1 11/2009 Dyson et al.
2009/0300874 A1 12/2009 Tran et al.
2009/0300875 A1 12/2009 Inge et al.
2009/0305862 A1 12/2009 Yoo
2009/0307564 A1 12/2009 Vedantham et al.
2009/0307863 A1 12/2009 Milne et al.
2009/0307864 A1 12/2009 Dyson
2009/0308254 A1 12/2009 Dakham
2009/0313958 A1 12/2009 Gomiciaga-Pereda et al.
2009/0313959 A1 12/2009 Gomiciaga-Pereda et al.
2010/0154150 A1 6/2010 McLeod
2010/0175217 A1 7/2010 Conrad
2010/0212104 A1 8/2010 Conrad
2010/0224073 A1 9/2010 Oh et al.
2010/0229321 A1 9/2010 Dyson et al.
2010/0229322 A1 9/2010 Conrad
2010/0242210 A1 9/2010 Conrad
2010/0243158 A1 9/2010 Conrad
2010/0293745 A1 11/2010 Coburn
2010/0299865 A1 12/2010 Conrad
2010/0299866 A1 12/2010 Conrad
2011/0146024 A1 6/2011 Conrad
2011/0168332 A1 7/2011 Bowe et al.
2011/0219570 A1 9/2011 Conrad
2012/0060322 A1 3/2012 Simonelli et al.
2012/0216361 A1 8/2012 Millington et al.
2012/0222245 A1 9/2012 Conrad
2012/0222262 A1 9/2012 Conrad
2014/0237758 A1 8/2014 Conrad
2014/0237759 A1 8/2014 Conrad
2014/0237768 A1 8/2014 Conrad
2016/0367094 A1 12/2016 Conrad

(56) References Cited

U.S. PATENT DOCUMENTS

FOREIGN PATENT DOCUMENTS

| | | | |
|---|---|---|---|
| CA | 1218962 | A | 3/1987 |
| CA | 2593950 | C | 6/2008 |
| CA | 2438079 | C | 8/2009 |
| CA | 2659212 | A1 | 9/2010 |
| CN | 1493244 | A | 5/2004 |
| CN | 2657570 | Y | 11/2004 |
| CN | 1887437 | A | 1/2007 |
| CN | 1911151 | B | 4/2007 |
| CN | 201223346 | Y | 4/2009 |
| CN | 101455540 | A | 6/2009 |
| CN | 101657133 | A | 2/2010 |
| CN | 102188208 | A | 9/2011 |
| CN | 103040412 | A | 4/2013 |
| CN | 103040413 | A | 4/2013 |
| DE | 875134 | C | 4/1953 |
| DE | 9017798 | U1 | 2/1992 |
| DE | 9216071.9 | U1 | 2/1993 |
| DE | 4232382 | C1 | 3/1994 |
| DE | 112007003039 | T5 | 10/2009 |
| DE | 112007003052 | T5 | 1/2010 |
| EP | 493950 | B1 | 7/1992 |
| EP | 1031310 | A2 | 8/2000 |
| EP | 1200196 | B1 | 6/2005 |
| EP | 1535560 | A2 | 6/2005 |
| EP | 1674017 | A2 | 6/2006 |
| EP | 1779761 | A2 | 5/2007 |
| EP | 1676516 | B1 | 1/2010 |
| EP | 1629758 | A3 | 10/2013 |
| FR | 2812531 | B1 | 11/2004 |
| GB | 700791 | A | 12/1953 |
| GB | 1029943 | A | 5/1966 |
| GB | 1111074 | A | 4/1968 |
| GB | 1386055 | A | 5/1975 |
| GB | 2163703 | B | 1/1988 |
| GB | 2268875 | A | 1/1994 |
| GB | 2282979 | B | 10/1997 |
| GB | 2365324 | B | 7/2002 |
| GB | 2372431 | A | 8/2002 |
| GB | 2441962 | B | 3/2011 |
| GB | 2466290 | B | 10/2012 |
| JP | 61131720 | A | 6/1986 |
| JP | 2000140533 | A | 5/2000 |
| JP | 2003180579 | A | 7/2003 |
| JP | 2010178773 | A | 8/2010 |
| JP | 2010220632 | A | 10/2010 |
| JP | 2011189132 | A | 9/2011 |
| JP | 2011189133 | A | 9/2011 |
| WO | 1980002561 | A1 | 11/1980 |
| WO | 9627446 | A1 | 9/1996 |
| WO | 9809121 | A1 | 3/1998 |
| WO | 9843721 | A1 | 10/1998 |
| WO | 01/07168 | A1 | 2/2001 |
| WO | 2004069021 | A1 | 8/2004 |
| WO | 2006026414 | A3 | 8/2007 |
| WO | 2008009883 | A1 | 1/2008 |
| WO | 2008009888 | A1 | 1/2008 |
| WO | 2008009890 | A1 | 1/2008 |
| WO | 2008009891 | A1 | 1/2008 |
| WO | 2008070962 | A1 | 6/2008 |
| WO | 2009/026709 | A1 | 3/2009 |
| WO | 2009026709 | A1 | 3/2009 |
| WO | 2010102396 | A1 | 9/2010 |
| WO | 2010142968 | A1 | 12/2010 |
| WO | 2010142969 | A1 | 12/2010 |
| WO | 2010142970 | A1 | 12/2010 |
| WO | 2010142971 | A1 | 12/2010 |
| WO | 2011054106 | A1 | 5/2011 |
| WO | 2012042240 | A1 | 4/2012 |
| WO | 2012117231 | A1 | 9/2012 |

OTHER PUBLICATIONS

English machine translation of DE112007003052, as published on Jan. 14, 2010.

English machine translation of DE112007003039, as published on Oct. 29, 2009.

English machine translation of CN103040413, as published on Apr. 17, 2013.

English machine translation of CN103040412, as published on Apr. 17, 2013.

English machine translation of CN102188208, as published on Sep. 21, 2011.

English machine translation of CN101657133, as published on Feb. 24, 2010.

English machine translation of CN1911151, as published on Feb. 14, 2007.

* cited by examiner

HAND CARRIABLE SURFACE CLEANING APPARATUS

CROSS-REFERENCE TO RELATED APPLICATIONS

This application is a continuation of U.S. patent application Ser. No. 14/994,495, filed on Jan. 13, 2016, which is a continuation of U.S. patent application Ser. No. 13/039,376, filed on Mar. 3, 2011, now U.S. Pat. No. 9,265,395, and which is a continuation in part of U.S. patent application Ser. No. 12/722,705, filed Mar. 12, 2010, now U.S. Pat. No. 8,578,555, the entirety of each of which is incorporated herein by reference.

FIELD OF INVENTION

The disclosure relates to surface cleaning apparatuses, such as vacuum cleaners.

INTRODUCTION

The following is not an admission that anything discussed below is prior art or part of the common general knowledge of persons skilled in the art.

Various constructions for surface cleaning apparatus such as vacuum cleaners are known. Currently, many surface cleaning apparatus are constructed using at least one cyclonic cleaning stage. The air is drawn into the vacuum cleaner through a dirty air inlet and conveyed to a cyclone inlet. The rotation of the air in the cyclone chamber results in some of the particulate matter in the airflow stream being disentrained from the airflow stream. This material is then collected in a dirt collection chamber, which may be at the bottom of the cyclone chamber or in a dirt collection chamber exterior to the cyclone chamber (see for example WO2009/026709 and U.S. Pat. No. 5,078,761). One or more additional cyclonic cleaning stages and/or filters may be positioned downstream from the cyclone chamber.

SUMMARY

The following summary is provided to introduce the reader to the more detailed discussion to follow. The summary is not intended to limit or define the claims.

According to one aspect, a hand surface cleaning apparatus is provided that may be operable for an enhanced period of time without a significant reduction is air flow into the dirty air inlet. In accordance with this aspect, a pre-motor filter with enhanced surface area transverse to the direction of air flow is provided.

Typically, a surface cleaning apparatus such as a hand vacuum cleaner has a pre-motor filter and a post motor filter. The post motor filter may be a HEPA filter. In such a case, the air discharged from the clean air outlet of the unit may be comparable to that discharged from a full size vacuum cleaner. As the HEPA filter is used, the air flow through the unit will decrease and the suction provided by the unit will decrease. This can impact upon the cleaning performance achieved by the vacuum cleaner. To counter this, a larger suction motor may be provided. However, that would increase the hand weight of the unit. A pre-motor filter reduces the level of entrained dirt that will reach the HEPA filter. However, the filter will become clogged with use. Increasing the surface area of the upstream side of the pre-motor filter extends the lifetime of the pre-motor filter and may therefore enhance the life of a post motor filter.

The pre-motor filter may have an enhanced surface area of its upstream side by configuring the pre-motor filter to have a larger upstream surface area then that of the suction motor inlet end. A pre-motor filter may be positioned in the suction motor casing and may therefore have a diameter that is about the same as the diameter of the fan of the suction motor. By configuring the pre-motor filter to overlie part of one or more additional components of the unit, the surface area of the upstream side is increased.

For example, a suction motor may be positioned beside a cyclone chamber and extend in the same direction of the cyclone chamber. Accordingly, one end of a cyclone chamber may be adjacent the inlet end of the suction motor (e.g., positioned in about the same plane). The pre-motor filter (preferably a foam filter and more preferably a foam filter with a felt filter downstream thereof) may be configured to overlie part or all of the cyclone chamber as well as part or all of the suction motor. Alternately, or in addition, the pre-motor filter may overlie part of the open volume between the suction motor and the cyclone chamber. If the dirt collection chamber is exterior to the cyclone chamber, e.g., it is positioned to occupy some of the open volume, then the pre-motor filter may alternately or in addition overlie part or all of the dirt collection chamber. Accordingly, a pre-motor filter with an enhanced surface area of the upstream side may be provided without substantially increasing the size of the unit. A filter with an enhanced size may be provided by providing a filter that overlies part or all of two or more of the suction motor, the dirt collection chamber and the cyclone chamber.

According to this aspect, a surface cleaning apparatus is provided. The hand surface cleaning apparatus comprises an air flow passage extending from a dirty air inlet to a clean air outlet. A suction motor is positioned in the air flow path and has an inlet end and an outlet end. At least one cyclone chamber is positioned in the air flow path and has an associated dirt collection chamber, a cyclone air inlet and a cyclone air outlet. A pre-motor filter is positioned downstream of the cyclone chamber and upstream of the suction motor. The pre-motor filter has an upstream side and a downstream side. The pre-motor filter overlies at least a portion of the suction motor and the cyclone chamber.

The cyclone chamber and the suction motor may be positioned side by side and may have generally parallel longitudinal axes.

The pre-motor filter may overlie at least half of the suction motor and the cyclone chamber. The pre-motor filter may overlie at least 75% of the suction motor and the cyclone chamber.

The pre-motor filter may have a portion that is centered over the suction motor and a portion that overlies at least half of the cyclone chamber.

The upstream side of the pre-motor filter may face the cyclone air outlet and an inlet duct of the suction motor may extend through the pre-motor filter to the downstream side of the pre-motor filter.

The cyclone air outlet may extend through the pre-motor filter to the upstream side of the pre-motor filter, and the inlet end of the suction motor may face the downstream side of the pre-motor filter.

The hand surface cleaning apparatus may further comprising an openable door positioned at a side of the hand vacuum cleaner having the cyclone air outlet and the inlet end of the suction motor. The upstream side of the pre-motor filter may be visible when the door is opened.

The pre-motor filter may be mounted to at least one of the cyclone chamber and the suction motor and the pre-motor filter may remain in position when the door is opened.

The pre-motor filter may be spaced from the door and a chamber may be provided between the pre-motor filter and the door.

BRIEF DESCRIPTION OF THE DRAWINGS

Reference is made in the detailed description to the accompanying drawings, in which.

DETAILED DESCRIPTION

Figure 1:
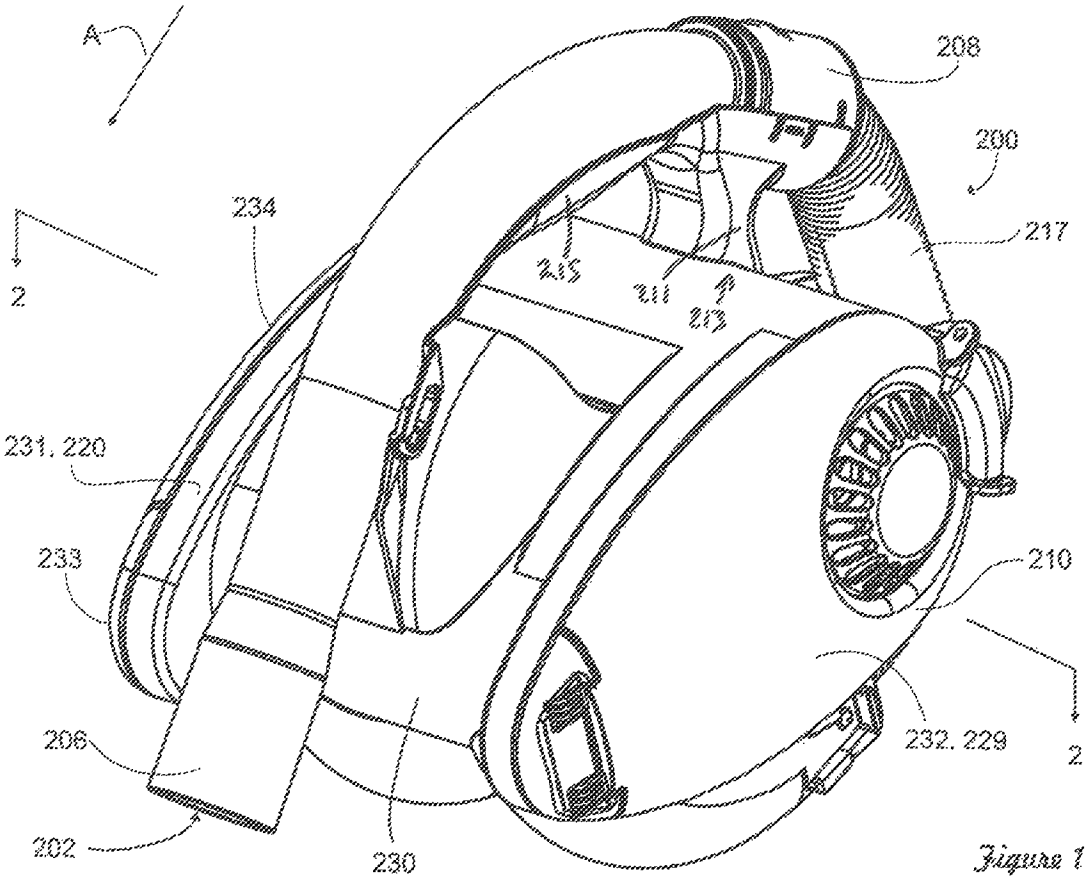
FIG. 1 is a perspective illustration of an embodiment of a surface cleaning apparatus.

Referring to FIG. 1, an embodiment of a surface cleaning apparatus 200 is shown. In this embodiment the surface cleaning apparatus 200 is a hand operable surface cleaning apparatus. The surface cleaning apparatus 200 is usable in a forward direction of motion, indicated by arrow A in FIG. 1. A handle 215 is provided on an upper portion of the surface cleaning apparatus 200. The handle 215 is configured to be grasped by a user, and can be used to manipulate the surface cleaning apparatus 200. In the illustrated example, a first portion 211 of the handle 215 is connected to the surface cleaning apparatus 200 at a first location 213.

Figure 2:
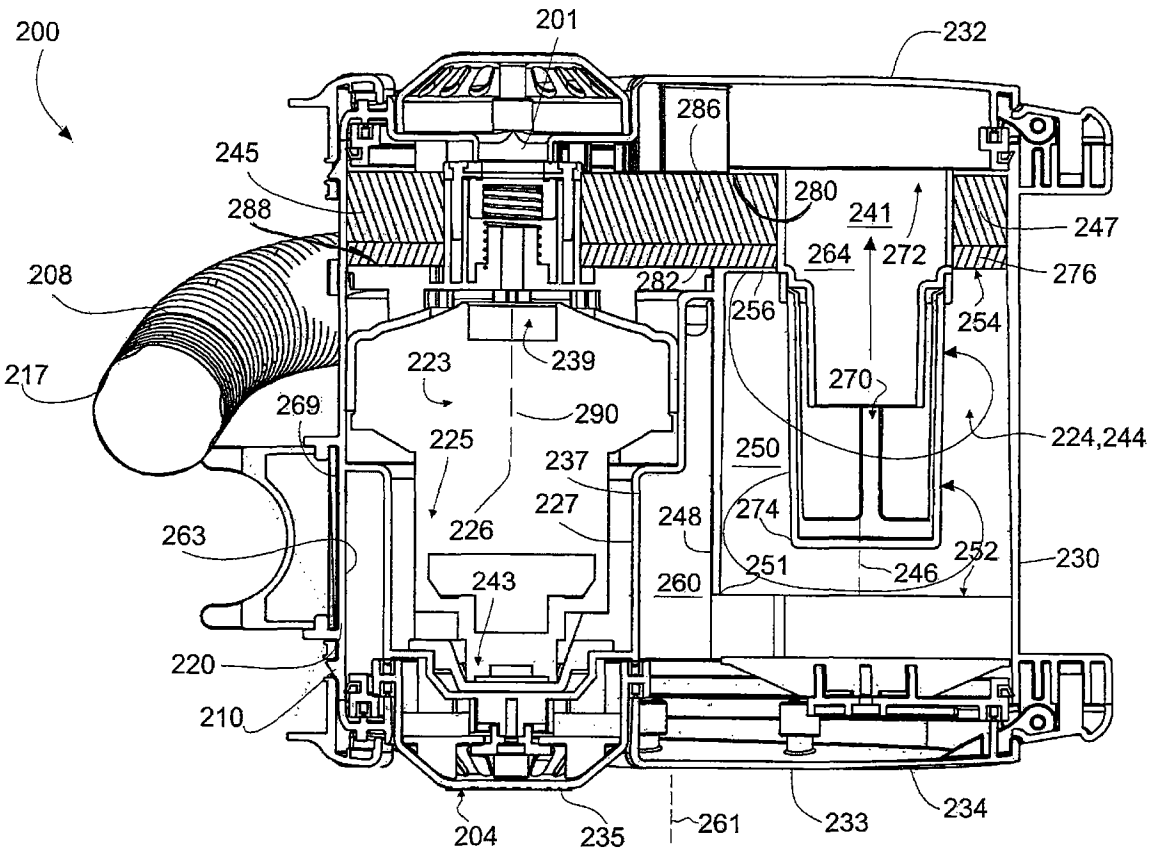
FIG. 2 is a cross section taken along line 2-2 in FIG. 1.

Referring to FIG. 2, the surface cleaning apparatus 200 has a dirty air inlet 202, a clean air outlet 204 (shown in FIG. 2), and an air flow passage extending therebetween. In the embodiment shown, the dirty air inlet 202 is provided in a nozzle 206. From the dirty air inlet 202, the airflow passage extends through the nozzle 206, and through an air conduit 208, to a suction and filtration unit 210. The clean air outlet 204 is provided in the suction and filtration unit 110. In the embodiment shown, the air conduit 108 includes a wand 214, and a hose 217.

Referring now to FIGS. 1 and 2, the suction and filtration unit 210 includes a main housing 220. A filtration member 224 is provided in the main housing 220, and the filtration member 224 is positioned in the airflow passage downstream of the dirty air inlet 202, for removing particulate matter from air flowing through the airflow passage.

A suction motor 226 is also provided in the main housing 220, downstream of the filtration member 224, for drawing air through the airflow passage. The suction motor 226 may be any suitable type of suction motor. In the embodiment shown, the suction motor 226 includes a fan 223, and a motor 225.

In the embodiment shown, the filtration member 224 and suction motor 226 are positioned side-by-side. Further, the filtration member 224 extends along an axis 246, and the suction motor extends along an axis 290, and the axes 246, 290 are generally parallel. Further, the filtration member 224 and suction motor 226 are each positioned transverse to the forward direction of motion (indicated by arrow A in FIG. 1) of the hand surface cleaning apparatus 100.

Referring to FIG. 1, in the embodiment shown, the main housing 220 includes a central wall 230, a first side wall 232, and a second side wall 234. The first side wall 232 is pivotally mounted to the central wall 230, and serves as a first openable door 229. The second sidewall 234 has a first portion 233 adjacent the filtration member 224, and a second portion 235 adjacent the suction motor 226. The second sidewall 234 is pivotally mounted to the central wall 230, and serves as a second openable door 231. Further, the second portion 235 is removable from the first portion 233.

Referring to FIG. 2, an interior wall 237 extends within the main housing 220 to separate the suction motor 226 from the filtration member 224, so that fluid communication between the filtration member 224 and the suction motor 226 may generally only occur between a filtration member air outlet 264, and a suction motor air inlet end 239, as will be described in further detail hereinbelow. The interior wall 237 generally surrounds the suction motor 226 to form a motor housing 227, and is integral with the central wall 230, so that a portion 269 of the motor housing 227 forms part of the housing 220.

Referring to FIG. 2, in the embodiment shown, the filtration member 224 is a cyclone 244. In alternate embodiments, the filtration member 224 may be, for example, a filter, such as a filter bag or a foam filter. In further alternate embodiments, the filtration member 224 may include a plurality of cyclone chambers, or a plurality of cyclonic stages.

The cyclone 244 may be of any suitable configuration. The cyclone 244 includes a cyclone wall 248 (also referred to as an outer wall 248), which is integral with the central wall 230, and together with the central wall 230 defines a cyclone chamber 250. That is, a portion of the cyclone wall 248 forms part of the housing 220. A first end 251 of the cyclone wall 148, which is positioned towards the second sidewall 234, defines an opening 252, and an opposed second end 254 of the cyclone wall includes a second end wall 256. The cyclone wall 248 is positioned in the main housing 220 such that it is spaced from the second sidewall 234.

The open first end 252 of the cyclone serves as a dirt outlet for the cyclone 244. Material that is separated form air in the cyclone travels from the dirt outlet to an associated dirt collection chamber 260.

Figure 3:
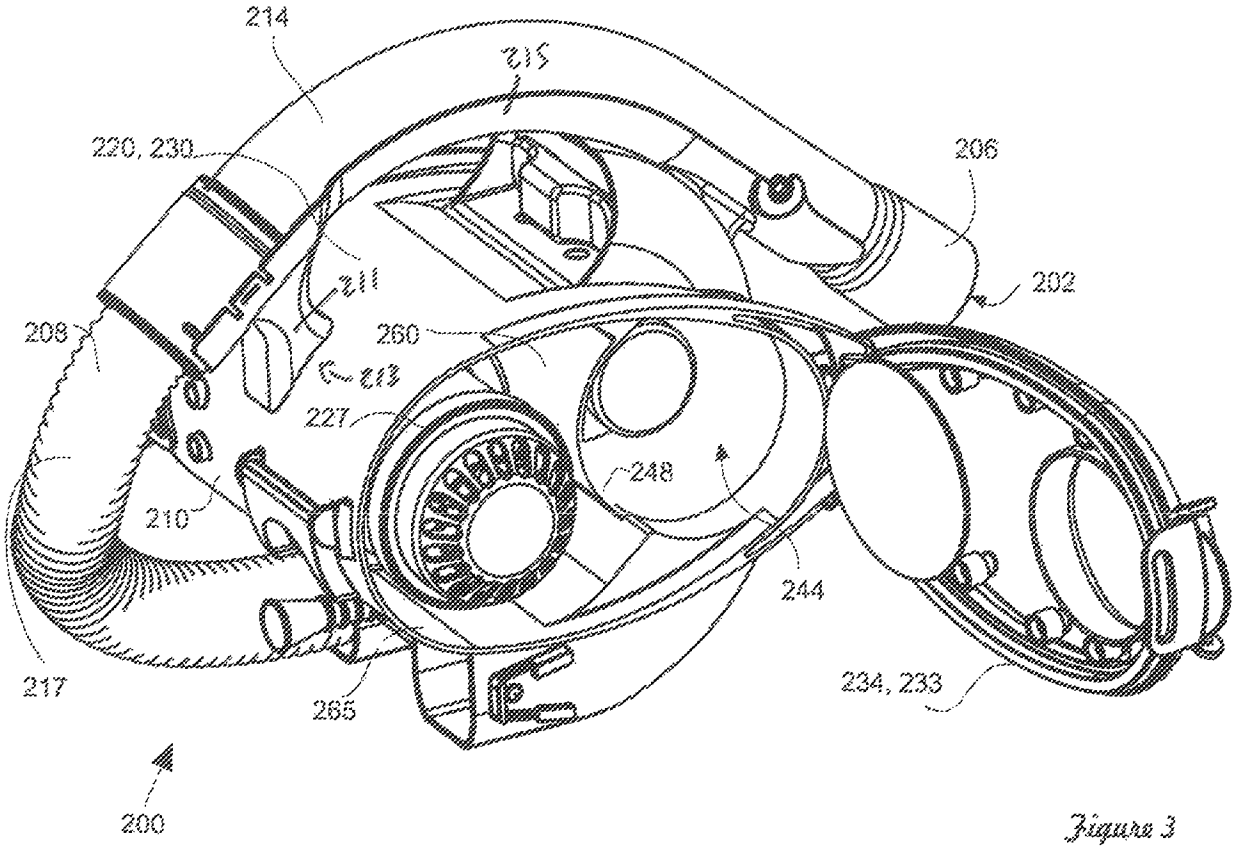
FIG. 3 is a perspective illustration of the surface cleaning apparatus of FIG. 1, showing a second openable door in an open configuration.
Figure 3D:
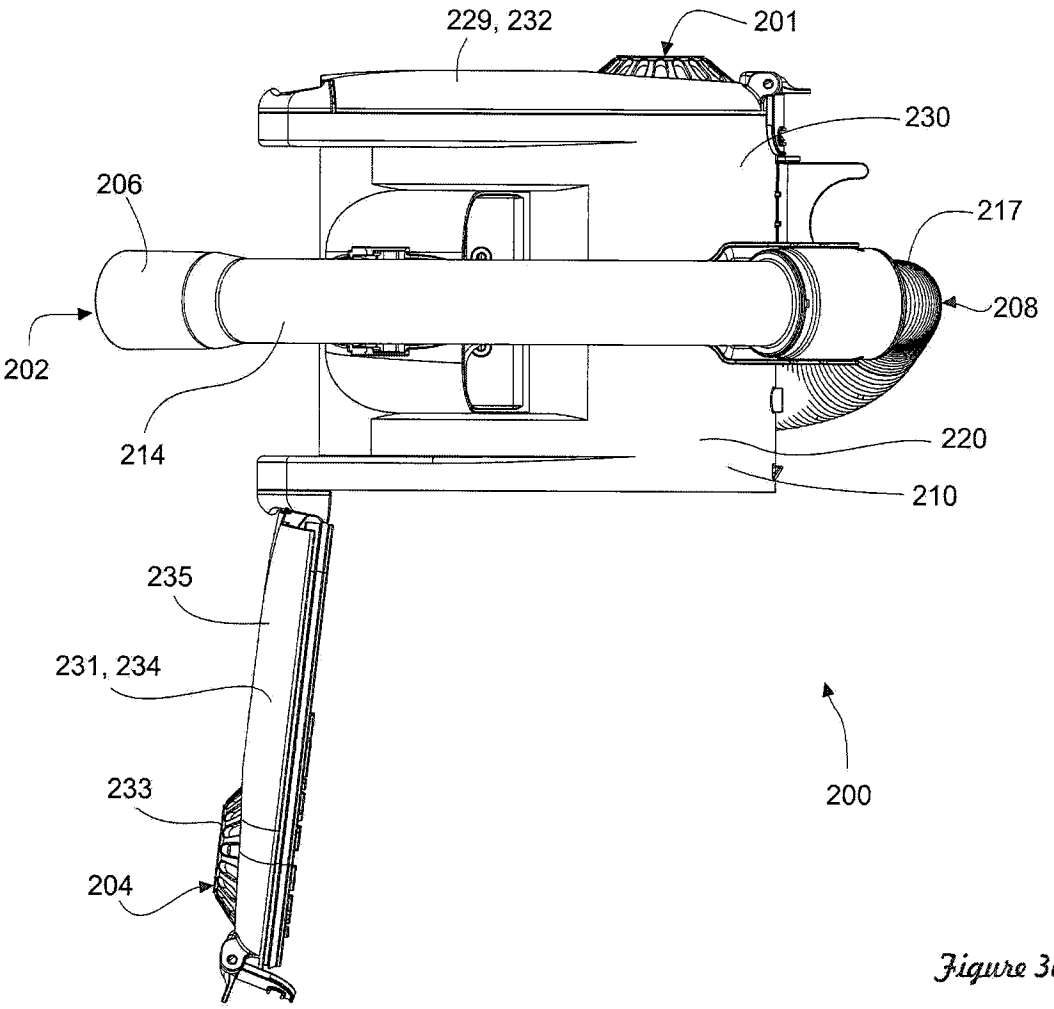
FIG. 3A is a side plan view of the surface cleaning apparatus of FIG. 1, showing a second openable door in an open configuration.
FIG. 3B is a perspective illustration of the surface cleaning apparatus of FIG. 1 showing a first openable door in an open configuration.

Referring to FIGS. 2 and 3, at least a portion of the dirt chamber 260 is preferably positioned in an open volume within the main housing 220. In the embodiment shown, the entire dirt chamber 260 is within an open volume within the main housing 220. The dirt collection chamber 260 is preferably within the main housing 220, exterior to the cyclone 244 and the suction motor 226. The dirt collection chamber extends along a longitudinal axis 261. The longitudinal axis 261 is preferably parallel to the suction motor axis 290.

Referring to FIGS. 2 and 3, at least a portion of the dirt collection chamber 260 is preferably positioned between the cyclone 244 and the suction motor 226. More preferably, at least a portion of the dirt collection chamber 260 surrounds at least a portion of the suction motor 226 and the suction motor housing 227. For example, the dirt collection chamber 260 may surround all of the suction motor 226, or only a portion of the suction motor 226, and/or all of the suction motor housing 227, or only a portion of the suction motor housing 227. As seen most clearly in FIG. 3, in the embodiment shown, the dirt collection chamber 260 fully surround the motor 225 of suction motor 226 and the portion suction motor housing 227 that houses the motor 225.

The dirt collection chamber 260 further preferably surrounds at least a portion of the cyclone. For example, in the embodiment shown, dirt collection chamber 260 extends around approximately one quarter of the cyclone 244. In alternate embodiments, the dirt collection chamber 260 may fully surround the cyclone 244.

Figure 4:
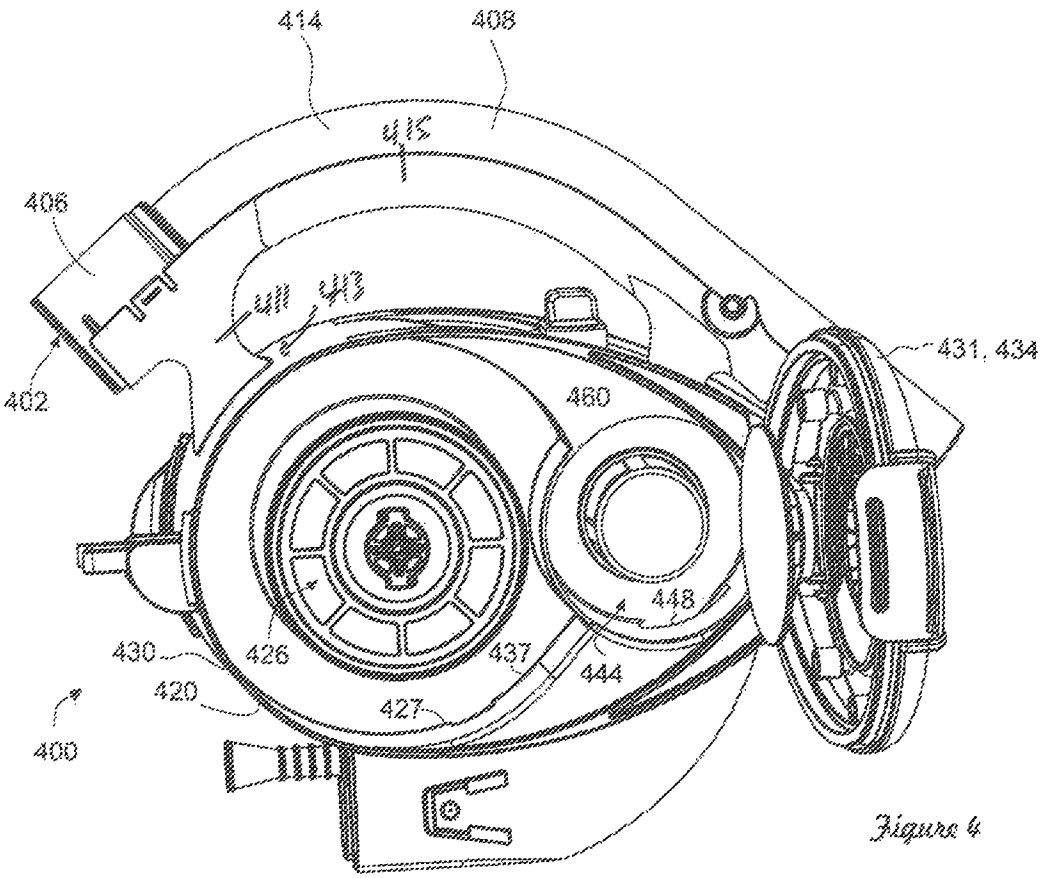
FIG. 4 is a plan view of an alternate embodiment of a surface cleaning apparatus, showing a second openable door in an open configuration.
Figure 4B:
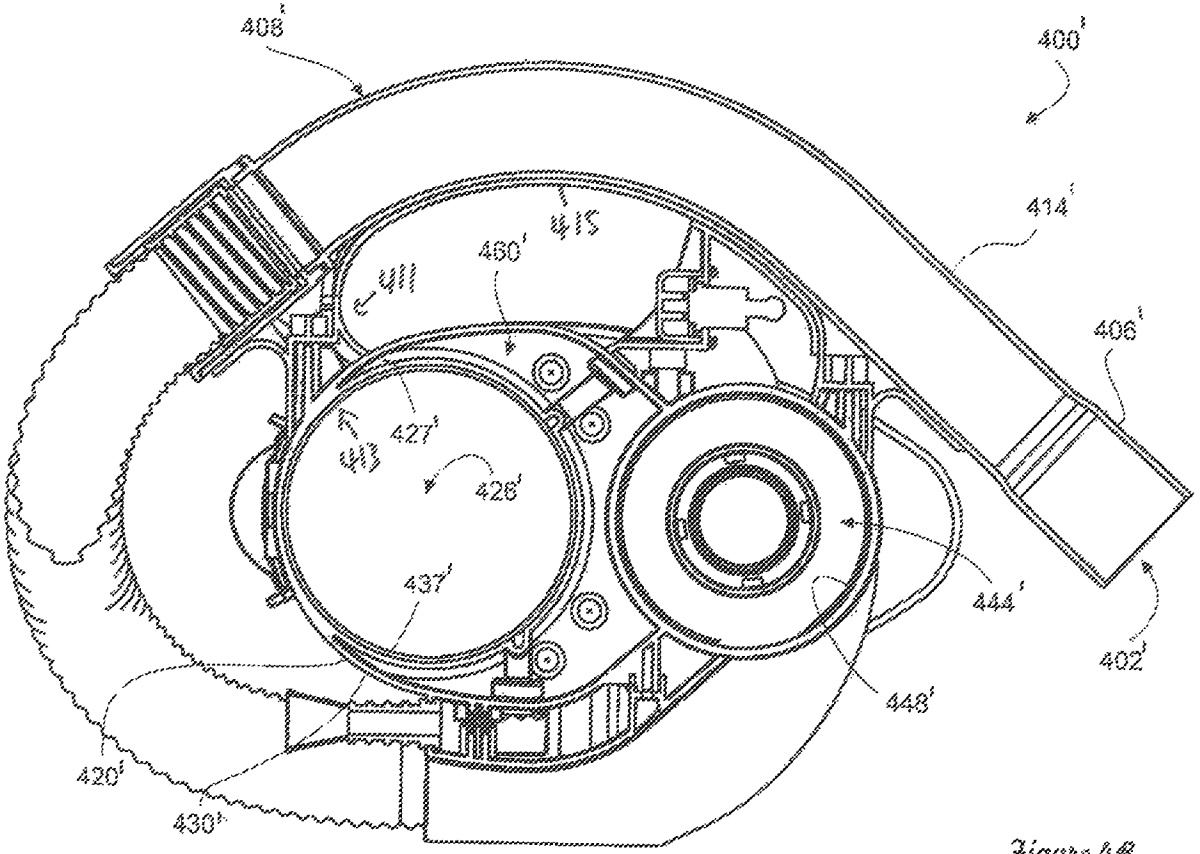
FIG. 4B is a plan view of another alternate embodiment of a surface cleaning apparatus, showing a second openable door in an open configuration.

In an alternate embodiment of a surface cleaning apparatus 400 shown in FIG. 4, wherein like reference numerals are used to refer to like features as in FIGS. 1 to 3, with the first digit incremented to 4, the dirt collection chamber 460 partially surrounds the motor 425 of suction motor 426 and the portion suction motor housing 427 that houses the motor 425. Further, the dirt collection chamber 460 partially surrounds the cyclone 444. Particularly, the dirt collection chamber 460 surrounds approximately three quarters of the cyclone 444. In another alternate embodiment of a surface cleaning apparatus 400' shown in FIG. 5, wherein like reference numerals are used to refer to like features as in FIG. 4, with a prime (') after the reference number, similarly to the embodiment of FIG. 4, the dirt collection chamber 460' partially surrounds the motor 425' of suction motor 426' and the portion suction motor housing 427' that houses the motor 425'. Further, the dirt collection chamber 460' partially surrounds the cyclone 444'. Particularly, the dirt collection chamber 460' surrounds approximately one quarter of the cyclone 444'.

Referring to FIG. 3, the dirt collection chamber 260 has an outer wall 263, and a portion 265 of the outer wall 263 preferably forms part of the main housing 220.

The cyclone 244 further includes a cyclone air inlet (not shown), and a cyclone air outlet 264. The cyclone air inlet extends from a first end that is in communication with the hose 217 through the central wall 230 of the filtration member main housing 220, to a second end that is in communication with the cyclone chamber 250. The cyclone air outlet 264 extends along the axis 246, from a first end 270 that is positioned within the cyclone chamber 250, through the lower wall 156, and to a second end 272 (also referred to herein as an outlet 272 of the cyclone air outlet 264) that is in communication with a chamber 241 adjacent the first sidewall 232 of the suction and filtration unit 210. A screen 274 is preferably mounted over the first end 270 of the cyclone air outlet.

In use, air flows from the hose 217 into the cyclone chamber 250 through the cyclone air inlet. In the cyclone chamber 250, the air flows within the cyclone wall 248 in a cyclonic pattern, and particulate matter is separated from the air. The particulate matter exits the cyclone chamber 250 through the open first end 252, and settles in the dirt collection chamber 260. The air exits the cyclone chamber 250 through the cyclone air outlet 264, and enters the chamber 241

The dirt collection chamber 260 may be emptied in any suitable manner. Referring to FIG. 3A, in the embodiment shown, the second side wall 234 is pivotally openable, so that the dirt collection chamber 260 may be opened.

Referring still to FIG. 2, the surface cleaning apparatus includes a pre-motor filter 276 positioned downstream of the cyclone 244 and upstream of the suction motor 226. The pre-motor filter 276 is preferably housed in the chamber 241, is snugly received within the central wall 230, overlies the suction motor 226 and the cyclone 244, and spaced from the first openable door 229. In the embodiment shown, the pre-motor filter 276 overlies the all of the suction motor 226 and the cyclone 244. In alternate embodiments, the pre-motor filter may overlie only a portion of the suction motor 226 and the cyclone 244. Preferably, the pre-motor filter 276 overlies at least half of the suction motor 226 and the cyclone chamber 250, and more preferably, at least 75% of the suction motor 226 and the cyclone chamber 250. More preferably, the pre-motor filter 276 overlies at least half of the suction motor 226 and the cyclone 244, and more preferably, at least 75% of the suction motor 226 and the cyclone 244. Most preferably, as shown, the pre-motor filter has a portion 245 that is centered over the suction motor 226 and a portion 247 that overlies at least half of the cyclone 244. In the embodiment shown, the portion 247 overlies all of the cyclone 244.

The pre-motor filter has an upstream side 280 that faces the first sidewall 232 of the main housing 220, and an opposed downstream side 282 that faces the second sidewall 234 of the main housing 220. The pre-motor filter 276 may be any suitable type of filter. Preferably, the pre-motor filter includes a foam layer 286 and a felt layer 288.

Referring still to FIG. 2, the cyclone air outlet 264 extends through the pre-motor filter 276, so that air exiting the pre-motor filter 276 is in contact with the upstream side 280 of the pre-motor filter 286.

The air then passes through the pre-motor filter 276, towards a suction motor inlet end 239 that faces the downstream side 282 of the pre-motor filter 276. From the suction motor inlet 239, the air passes towards a suction motor outlet end 243, and out of the clean air outlet 204.

Figure 3B:
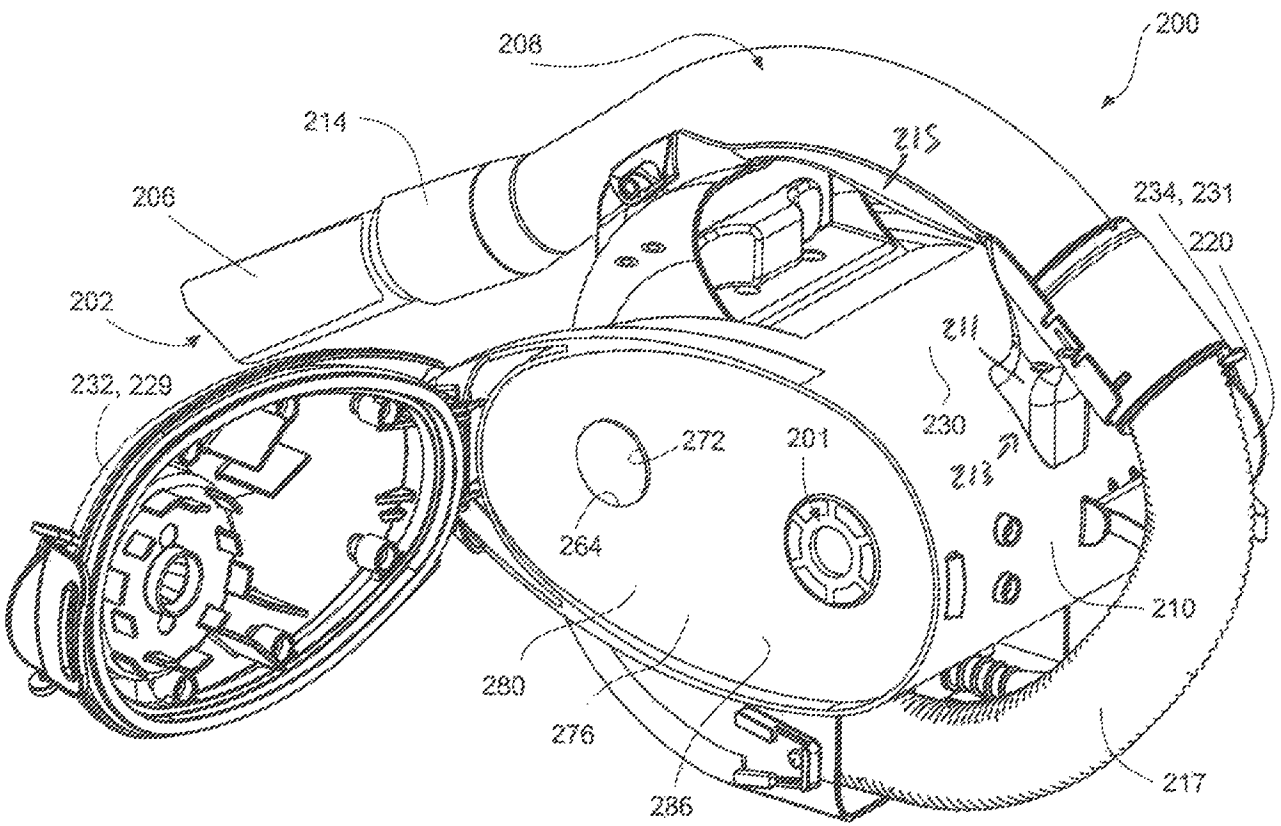

Preferably, as shown in FIG. 3B, when the first openable door 229 is open, the upstream side 280 of the pre-motor 276 is visible. By opening the openable door 229, the pre-motor filter may optionally be removed, replaced, or cleaned. Further, the pre-motor filter 276 is preferably mounted to at least one of the cyclone 244 and the suction motor 226, and the pre-motor filter 276 remains in position when the first openable door 229 is opened. For example, as shown, the pre-motor filter 276 is frictionally mounted to the cyclone air outlet 264.

Referring still to FIG. 2, the surface cleaning apparatus further includes a bleed valve 201. The bleed valve 201 allows air to flow from the suction motor inlet 239 to the clean air outlet 204 so that the suction motor 226 does not burn out if a clog occurs.

Figure 5:
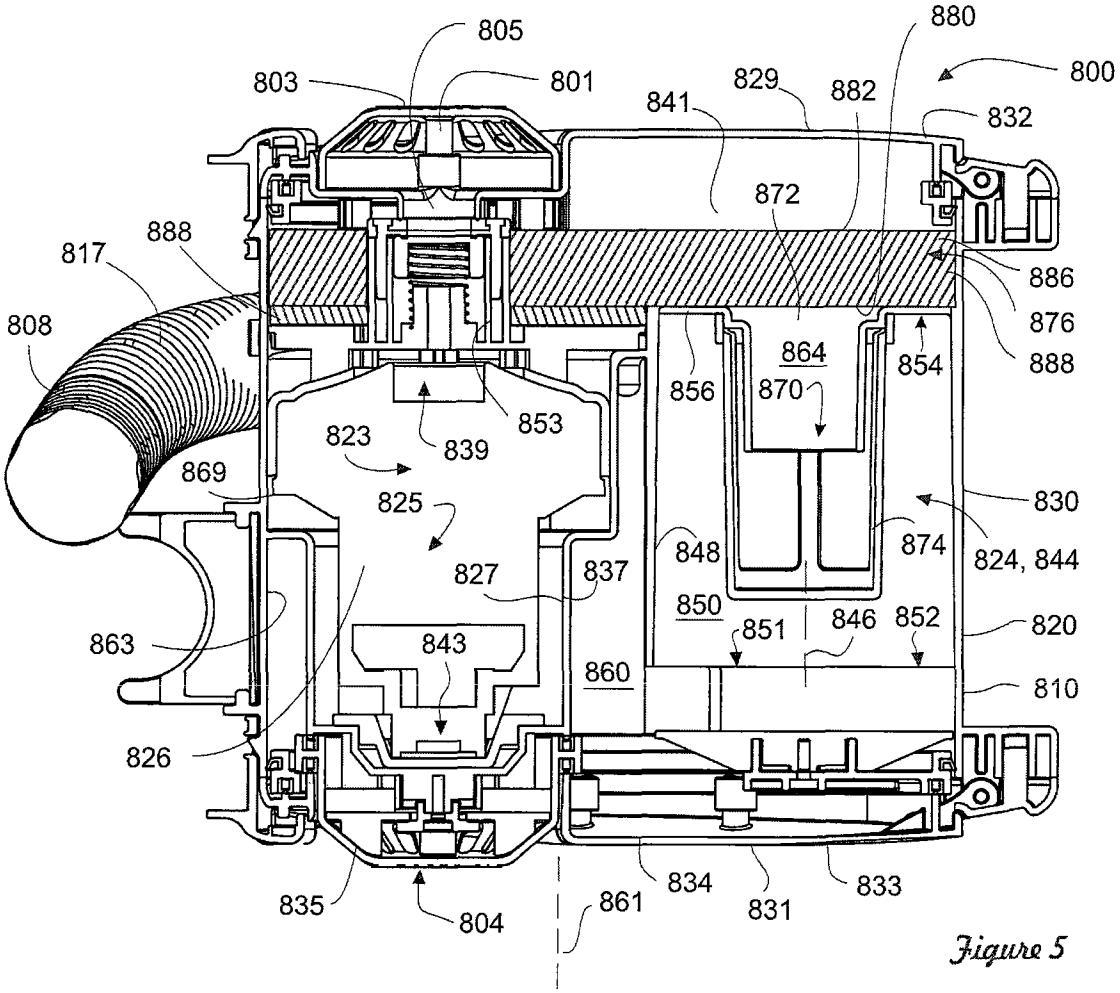
FIG. 5 is a cross section taken along the same line 2-2 through an alternate embodiment of a surface cleaning apparatus.

Referring to FIGS. 4 and 5, a further alternate surface cleaning apparatus 400 is shown. The surface cleaning apparatus is similar to the surface cleaning apparatus 200, and like numerals in the surface cleaning apparatus 800 will be used to describe like features as in the surface cleaning apparatus 200, with the first digit incremented to 8.

In the surface cleaning apparatus 800, the cyclone air outlet 864 does not extend through the pre-motor filter 876. The upstream side 880 of the pre-motor filter 876 faces towards the second sidewall 834 of the housing 820 and faces the cyclone air outlet 864, and the downstream side 882 of the pre-motor filter 876 faces the first sidewall 834. Air passes out of the second end 872 of the cyclone air outlet 864, through the pre-motor filter, and into the chamber 841.

The suction motor 826 has a suction motor inlet duct 853 that extends through the pre-motor filter 876 to the downstream side 882 of the pre-motor filter 876.

In this embodiment, the bleed valve 801 is provided in the openable door, and has an air outlet 805 that is within the chamber 841, so that it is in communication with the suction motor air inlet end 839.

When the openable door is open, the suction motor inlet 839 is visible, and the downstream side 882 of the pre-motor filter 876 is visible.

Figure 6A:
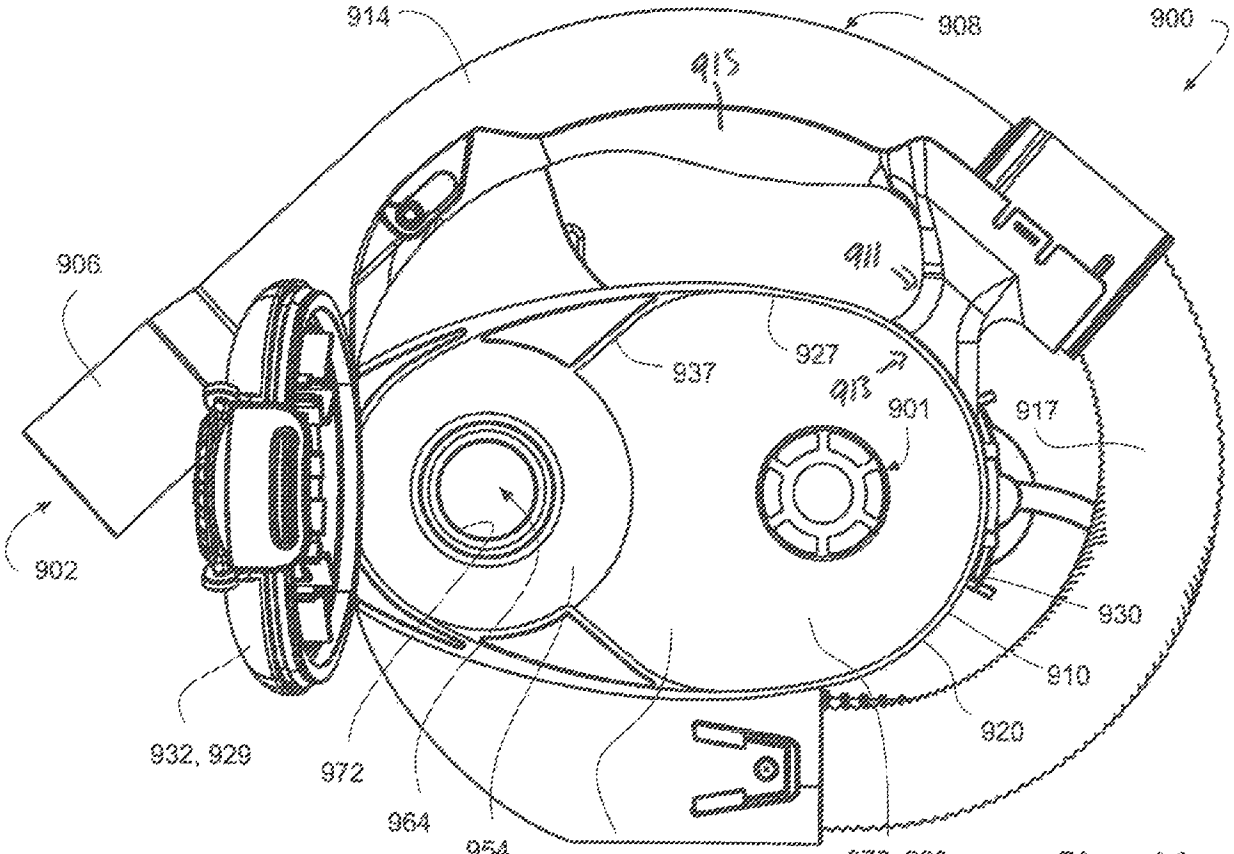
FIG. 6A is a plan view of an alternate embodiment of a surface cleaning apparatus, showing a first openable door in an open configuration.
Figure 6B:
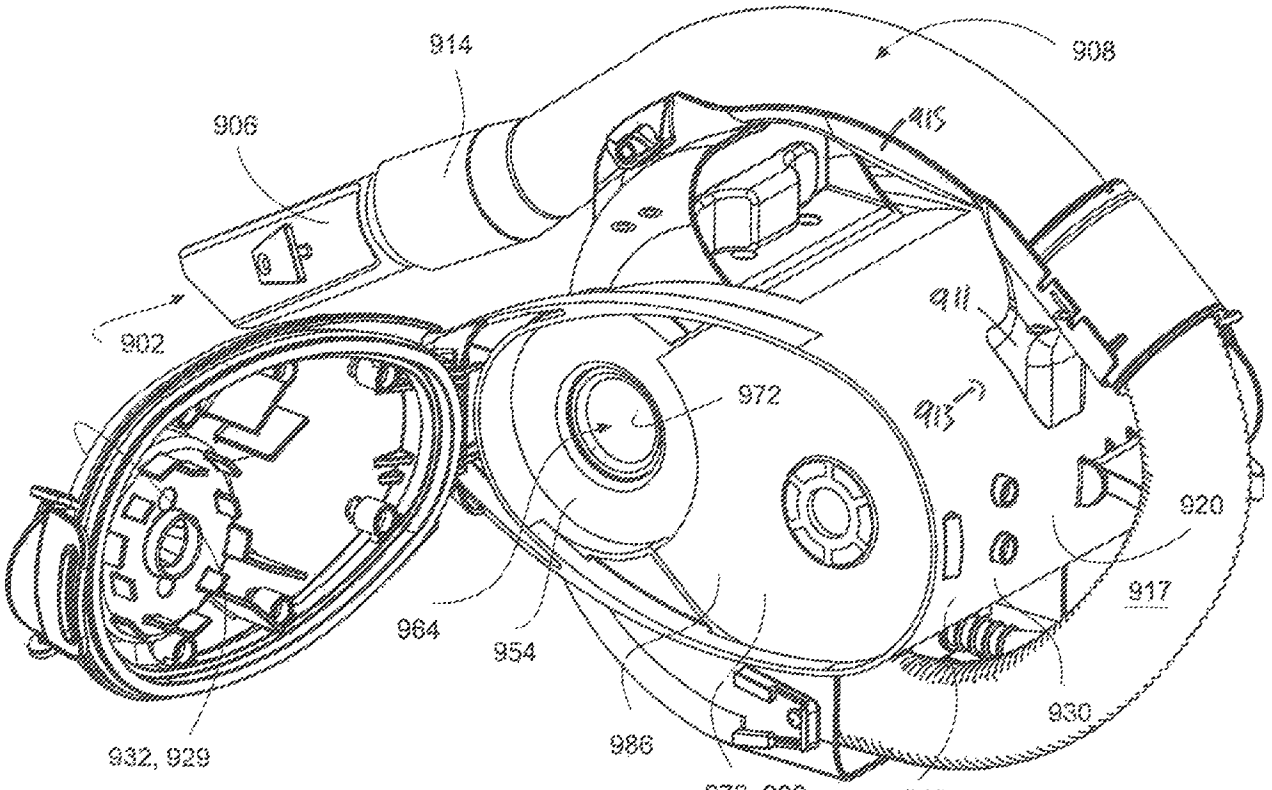
FIG. 6B is a perspective illustration of the surface cleaning apparatus of FIG. 6A.

Referring to FIGS. 6A and 6B, a further alternate surface cleaning apparatus 900 is shown. The surface cleaning apparatus is similar to the surface cleaning apparatus 200, and like numerals in the surface cleaning apparatus 900 will be used to describe like features as in the surface cleaning apparatus 200, with the first digit incremented to 9.

In the surface cleaning apparatus 900, the post motor filter 976 overlies only the motor (not shown) and the motor housing 927, and does not overlie the cyclone 944. The cyclone outlet 964 is in communication with the upstream side 980 of the post motor filter 976, which faces towards the first side 232 of the housing 220. The downstream side of the post motor filter 976 faces the motor inlet end (not shown) and the second side 234 of the housing 920. A bleed valve 901 extends through the post motor filter 976.

Referring to FIGS. 7-10, a further alternate surface cleaning apparatus 1100 is shown. In the embodiment illustrated, the surface cleaning apparatus 1100 is a hand operable surface cleaning apparatus. In alternate embodiments, the surface cleaning apparatus may be another suitable type of surface cleaning apparatus, including, for example, an upright vacuum cleaner, a canister vacuum cleaner, a stick vacuum cleaner, a wet-dry vacuum cleaner and a carpet extractor.

Figure 10:
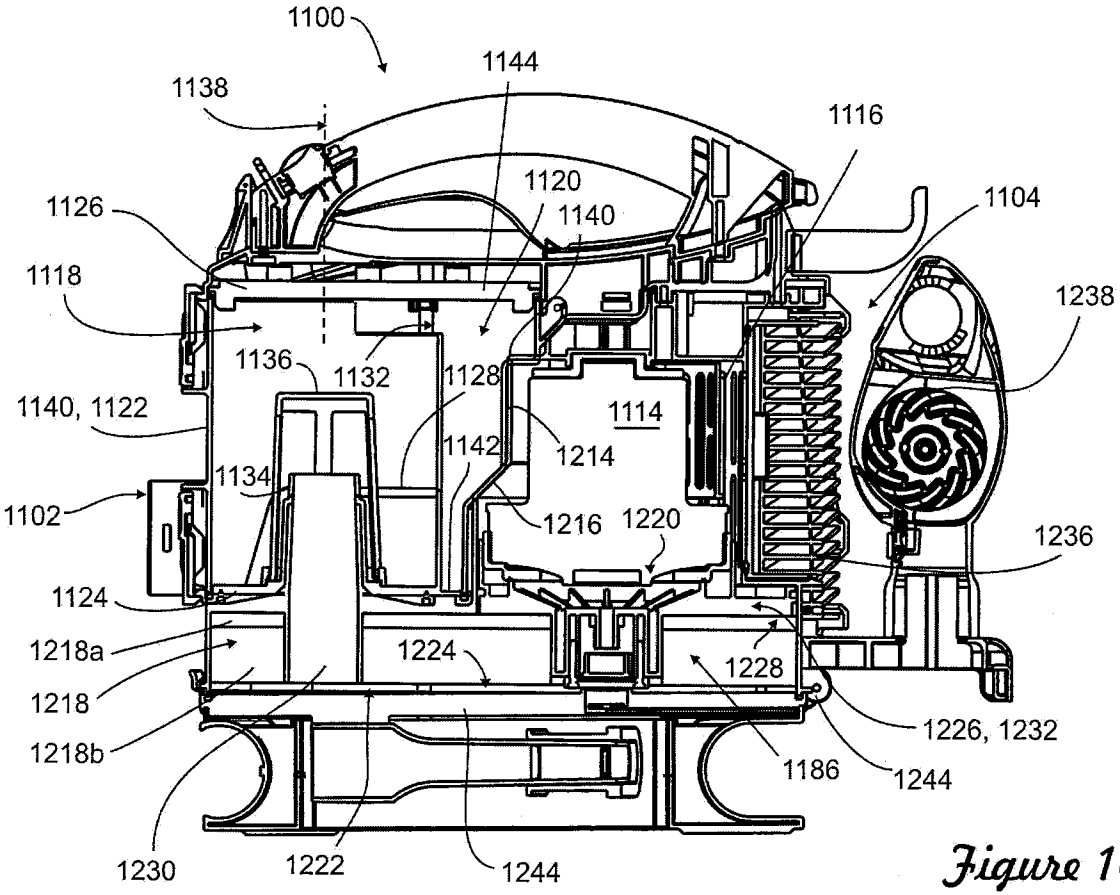
FIG. 10 is a section view taken along line 10-10 in FIG. 7.
Figure 11:
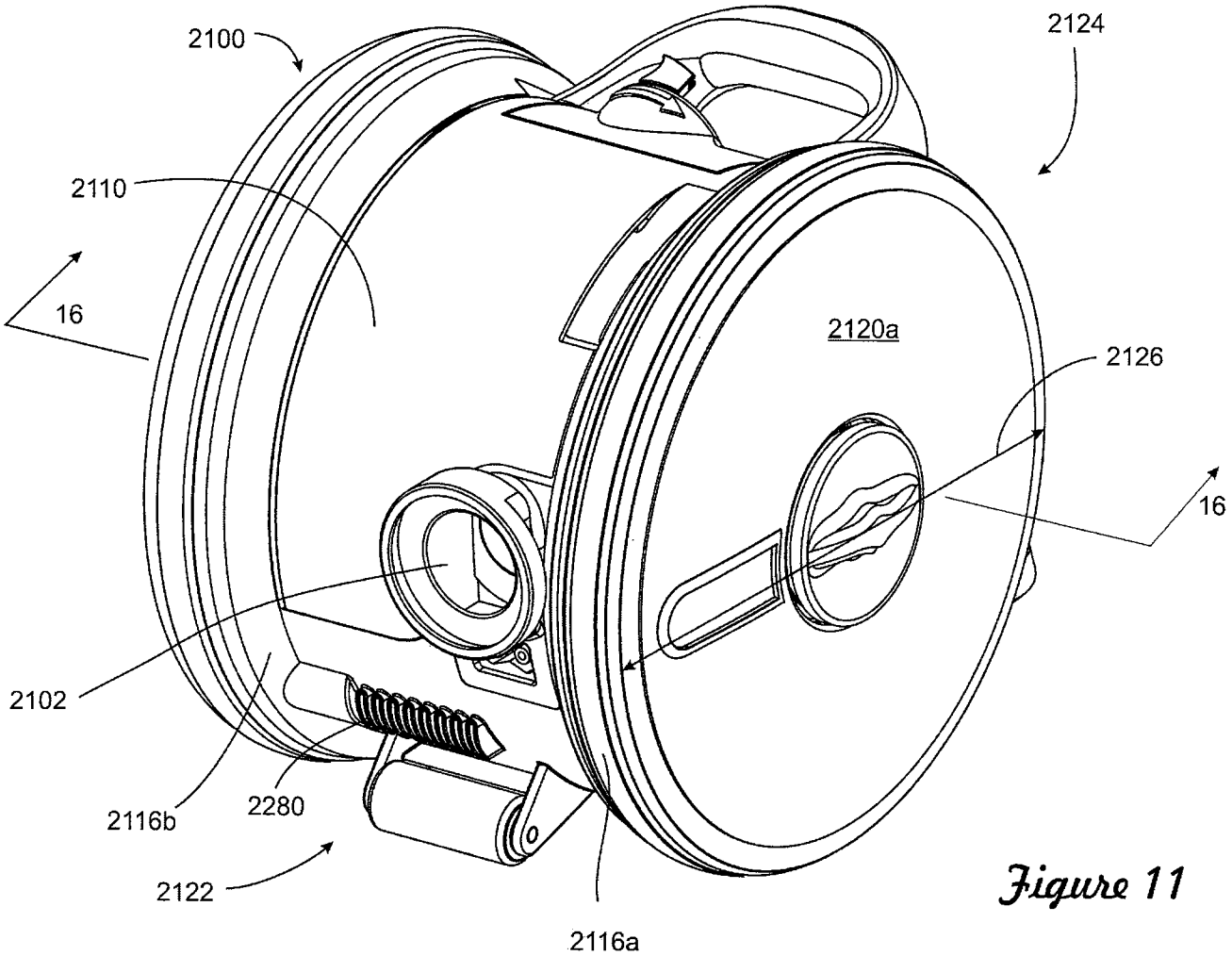
FIG. 11 is a perspective illustration of an alternate embodiment of a surface cleaning apparatus.

Referring to FIG. 10, the surface cleaning apparatus 1100 has a dirty air inlet 1102, a clean air outlet 1104 and an airflow passage extending therebetween. In the embodiment shown, the dirty air inlet 1102 is the air inlet 1106 of a suction hose connector 1108 that can be connected to the downstream end of, e.g., a flexible suction hose or other type of cleaning accessory tool, including, for example, a wand and a nozzle. From the dirty air inlet 1102, the airflow passage extends through an air treatment member that can treat the air in a desired manner, including for example removing dirt particles and debris from the air. In the illustrated example, the air treatment member comprises a cyclone bin assembly 1110. The cyclone bin assembly 1110 is mounted on a body 1112. Alternatively, or in addition, the air treatment member can comprise a bag, a filter or other air treating means. A suction motor 1114 that is mounted within the body 1112 and is in fluid communication with the cyclone bin assembly 1110.

The clean air outlet 1104, which is in fluid communication with an outlet of the suction motor 1114, is provided in the body 1112. In the illustrated example, the dirty air inlet 1102 is located toward the front of the surface cleaning apparatus 1100, and the clear air outlet 1104 is located toward the rear.

In the illustrated example, cyclone bin assembly 1110 includes a cyclone chamber 1118 and a dirt collection chamber 1120. The cyclone chamber 1118 is bounded by a sidewall 1122, a first end wall 1124 and a second end wall 1126 that are configured to provide an inverted cyclone configuration. A tangential air inlet 1128 is provided in the sidewall of the cyclone chamber 1118 and is in fluid communication with the air outlet of the hose connector 1108. Air flowing into the cyclone chamber 1118 via the tangential air inlet 1128 can circulate around the interior of the cyclone chamber 1118 and dirt particles and other debris can become disentrained from the circulating air.

A slot 1132 formed between the sidewall 1122 and the second end wall 1126 serves as a cyclone dirt outlet 1132. Debris separated from the air flow in the cyclone chamber 1118 can travel from the cyclone chamber 1118, through the dirt outlet 1132 to the dirt collection chamber 1120.

Air can exit the cyclone chamber 1118 via an air outlet. In the illustrated example, the cyclone air outlet includes a vortex finder 1134. Optionally, a removable screen 1136 can be positioned over the vortex finder 1134. The cyclone chamber 1118 extends along a longitudinal cyclone axis 1138. In the example illustrated, the longitudinal cyclone axis 1138 is aligned with the orientation of the vortex finder 1134.

The dirt collection chamber 1120 comprises a sidewall 1140, a first end wall 1142 and an opposing second end wall 1144. In the illustrated example, at least a portion of the dirt collection chamber sidewall 1140 is integral with a portion of the cyclone chamber sidewall 1122, and at least a portion of the first cyclone end wall 1124 is integral with a portion of the first dirt collection chamber end wall 1142.

Figure 8:
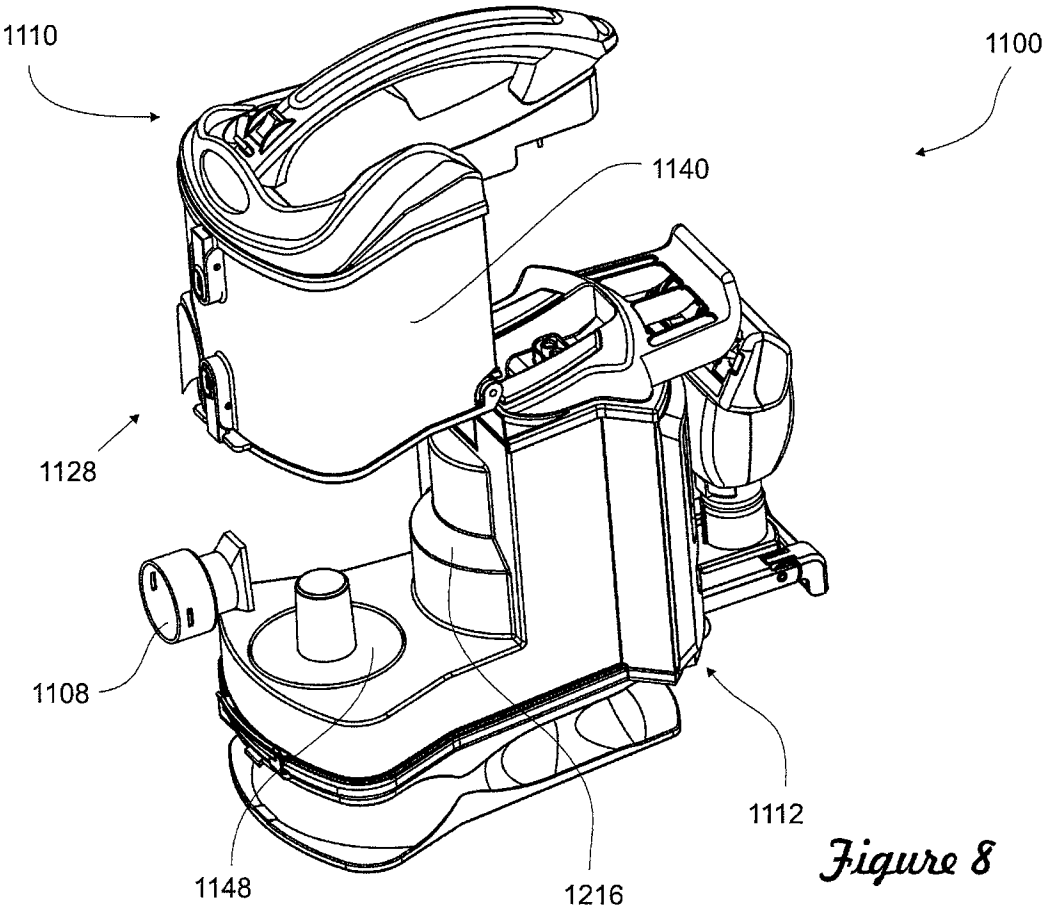
FIG. 8 is a perspective illustration of the surface cleaning apparatus of FIG. 7, with its cyclone bin assembly removed.

Referring to FIG. 8, the cyclone bin assembly 1110 is optionally detachably connected to the body 1112. In the example illustrated, the cyclone bin assembly 1110 is detachably mounted on a platform 1148. A releasable latch 1150 can be used to secure a front edge of the cyclone bin assembly 1110 to the body 1112.

Figure 7:
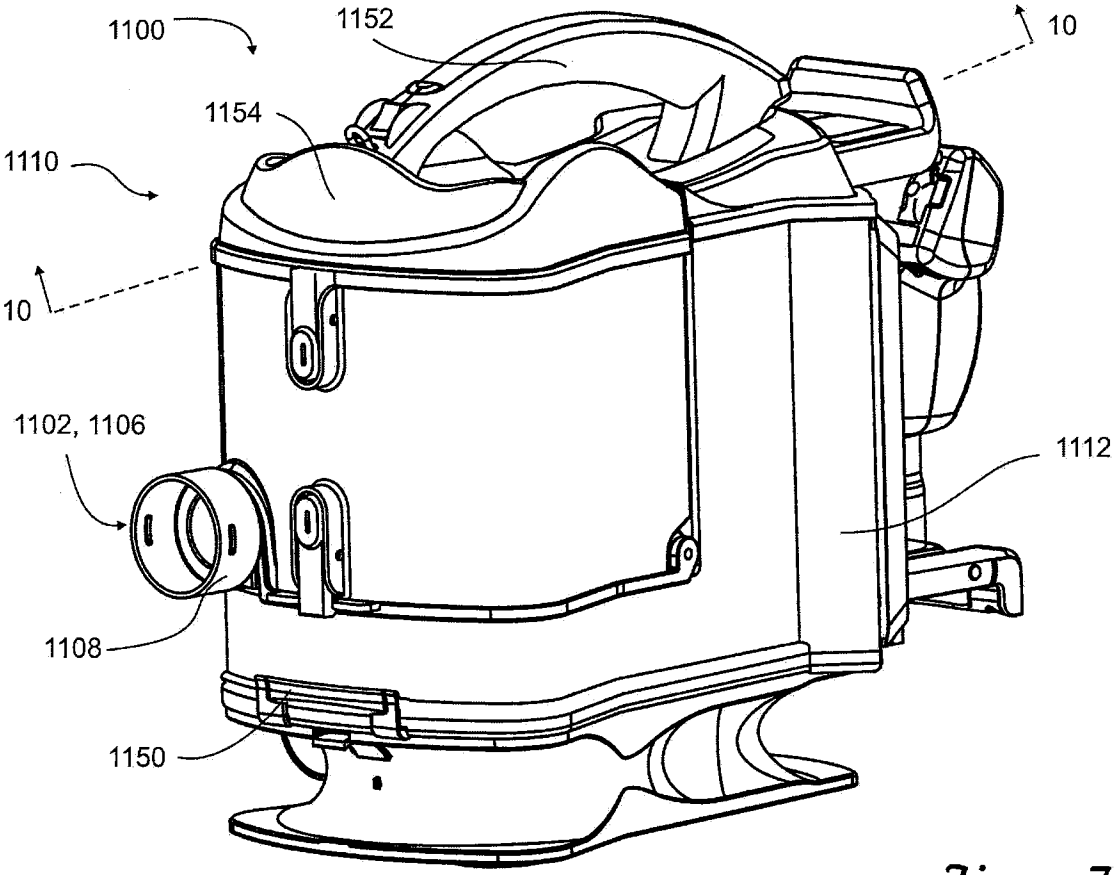
FIG. 7 is a perspective illustration of an alternate embodiment of a surface cleaning apparatus.

Referring to FIG. 7, a handle 1152 is provided on the top of the cyclone bin assembly 1110. The handle 1152 is configured to be grasped by a user. When the cyclone bin assembly 1110 is mounted on the body 1112, the handle 1152 can be used to manipulate the surface cleaning apparatus 1100. When the cyclone bin assembly 1110 is removed from the body 1112, the handle 1152 can be used to carry the cyclone bin assembly 110, for example to position the cyclone bin assembly 1110 above a waste receptacle for emptying. In the illustrated example, the handle 1152 is integral with a lid 1154 of the cyclone bin assembly 110.

Figure 9:
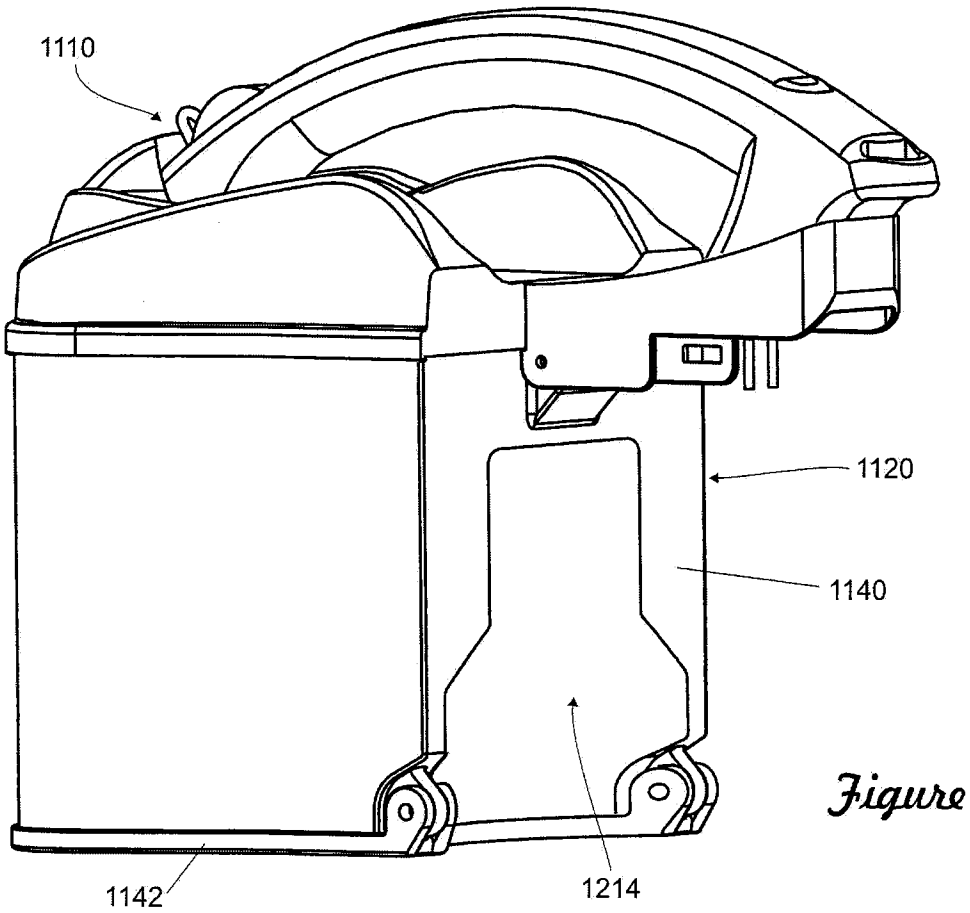
FIG. 9 is a perspective illustration of the cyclone bin assembly of FIG. 8.

Referring to FIGS. 9 and 10, the dirt collection chamber sidewall 1140 comprises a recess 1214 that is shaped to receive a corresponding portion of the body 1112. In the illustrated example, the recess 1214 is shaped to receive a portion of the motor housing 1216 surrounding the suction motor 1114. In this example, at least a portion of the dirt collection chamber 1120 is positioned between the cyclone chamber 1118 and the suction motor 1114. Preferably, at least a portion of the dirt collection chamber 1120 surrounds at least a portion of the suction motor 1114 and, if a suction motor housing is provided, the suction motor housing 1216. In the illustrated example, the dirt collection chamber 1120 surrounds only a portion of the motor housing 1216. The shape of the recess 1214 is preferably selected to correspond to the shape of the suction motor housing 1216 so as to maximize the size of the dirt collection chamber for the foot print of the vacuum cleaner. Configuring the dirt collection chamber 1120 to at least partially surround the suction motor housing 216 may help reduce the overall length of the surface cleaning apparatus 1100, and/or may help increase the capacity of the dirt collection chamber 1120.

Referring to FIG. 10, the dirt collection chamber 1120 also surrounds at least a portion of the cyclone chamber 1118. Optionally, the dirt collection chamber 1120 can be configured to completely surround the cyclone chamber 1118.

Air exiting the cyclone chamber 1118 flows to a suction motor 1114 inlet via an filter chamber 1186. The filter chamber 1186 is provided downstream from the cyclone air outlet. In the illustrated example, the filter chamber 1186 extends over substantially the entire lower portion of the body 1112 and overlies substantially all of the cyclone chamber 1118, dirt collection chamber 1120 and suction motor 1114.

A pre-motor filter 1218 is provided in the filter chamber 1186 to filter the air before it enters the suction motor inlet 1220. The pre-motor filter 1218 is sized to cover the entire area of the filter chamber 1186, and overlies substantially all of the cyclone chamber 1118, dirt collection chamber 1120 and suction motor 1114. Preferably, the cross sectional area (in the direction of air flow) of the pre-motor filter 1218 is greater than the cross sectional area of the cyclone chamber 1118 and the suction motor 1114. In the illustrated example, the pre-motor filter 1218 comprises first and second pre-motor filters 1218*a*, 1218*b*. The filter chamber 1186 comprises an air inlet chamber 1222 on the upstream side 1224 of the pre-motor filter 1218, and an air outlet chamber 1226 on the downstream side 1228 of the pre-motor filter 1218. Air can travel from the air inlet chamber 1222 to the air outlet chamber 1226 by flowing through the air-permeable pre-motor filter 1218. It will be appreciated that the larger the cross sectional area of the upstream face of the filter, the greater the capacity of the filter to filter particulates without the filter becoming clogged. Accordingly, it is preferred to make pre-motor filter 1218 as large as possible. Accordingly, it is preferred that filter chamber 1186 is as large as possible (i.e. it overlies all of an end face of the cyclone chamber, dirt collection chamber and suction motor) and that the pre-motor filter 1218 extends over the full transverse extent of filter chamber 1186. It will be appreciated that the filter chamber 1186 may overlie only a portion of the end face of the cyclone chamber, dirt collection chamber and suction motor but may still provide a larger upstream surface area then is the filter only overlied the cyclone chamber.

The lower side of the air filtration chamber comprises a filtration chamber end wall 1244. Optionally, the first end wall 1244 of the filter chamber 1186 can be openable to allow a user to access the pre-motor filter 1218. In the illustrated example, the filter chamber end wall 1244 is pivotally connected to the body 1112 by a hinge 1246 and can pivot to an open position. The releasable latch 1150 can be used to secure in a closed position. The latch 1150 can connect the filter chamber end wall 1244 to the cyclone bin assembly 1110. As exemplified and discussed hereafter, the upstream side of pre-motor filter 1218 is visible when filter chamber end wall 1244 is in the open position and accordingly, a user may readily detect if the pre-motor filter 1218 requires cleaning or changing.

The air inlet chamber 1222 is fluidly connected to the cyclone chamber air outlet by an inlet conduit 1230 that extends through the pre-motor filter 1218. In the illustrated example the inlet conduit 1230 comprises an extension of a vortex finder insert. The air outlet chamber 1226 is in fluid communication with the inlet 1220 of the suction motor 1114. The pre-motor filter 1218 may be supported by a plurality of support ribs 1232 extending through the air outlet chamber 1226. Gaps or cutouts can be provided in the ribs 1232 to allow air to circulate within the air outlet chamber 1226 and flow toward the suction motor inlet 1220. From the suction motor inlet 1220, the air is drawn through the suction motor 1114 and ejected via a suction motor outlet 1116. Optionally, a post-motor filter 1236 (for example a HEPA filter) can be provided downstream from the suction motor outlet 1116, between the suction motor outlet 1116 and the clean air outlet 1104. A detachable grill 1238 can be used to retain the post-motor filter 1236 in position, and allow a user to access the post-motor filter 1236 for inspection or replacement.

Referring to FIGS. 11 to 16, another embodiment of a surface cleaning apparatus 2100 is shown. In the embodiment illustrated, the surface cleaning apparatus 2100 is a canister vacuum cleaner. The surface cleaning apparatus 2100 has a dirty air inlet 2102, a clean air outlet 2104 and an airflow passage extending therebetween. In the embodiment shown, the dirty air inlet 2102 is the air inlet of a suction hose connector 2106 that can be connected to the downstream end of a flexible suction hose or other type of cleaning accessory tool, including, for example, a surface cleaning head, a wand and a nozzle. From the dirty air inlet 2102, the airflow passage extends through an air treatment member 2108 that can treat the air in a desired manner, including for example removing dirt particles and debris from the air. In the illustrated example, the air treatment member 2108 comprises a cyclone bin assembly 2110. Alternatively, or in addition, the air treatment member 2108 can comprise a bag, a filter or other air treating means. A suction motor 2111 (FIG. 16) is mounted within a body 2112 of the surface cleaning apparatus 2100 and is in fluid communication with the cyclone bin assembly 2110. In the illustrated example, the body 2112 of the surface cleaning apparatus 2100 is a rollable, canister-type body that comprises a platform 2114 and two opposing sidewalls 2116*a*, 2116*b* that cooperate to define a central cavity 2118. The surface cleaning apparatus 2100 also comprises two main side wheels 2120*a*, 2120*b*, rotatably coupled to the sidewalls 2116*a* and 2116*b*, respectively.

The clean air outlet 2104, which is in fluid communication with an outlet of the suction motor 2111, is provided in the body 2112. In the illustrated example, the dirty air inlet 2102 is located toward the front 2122 of the surface cleaning apparatus 2100, and the clear air outlet is located toward the rear 2124.

Figure 16:
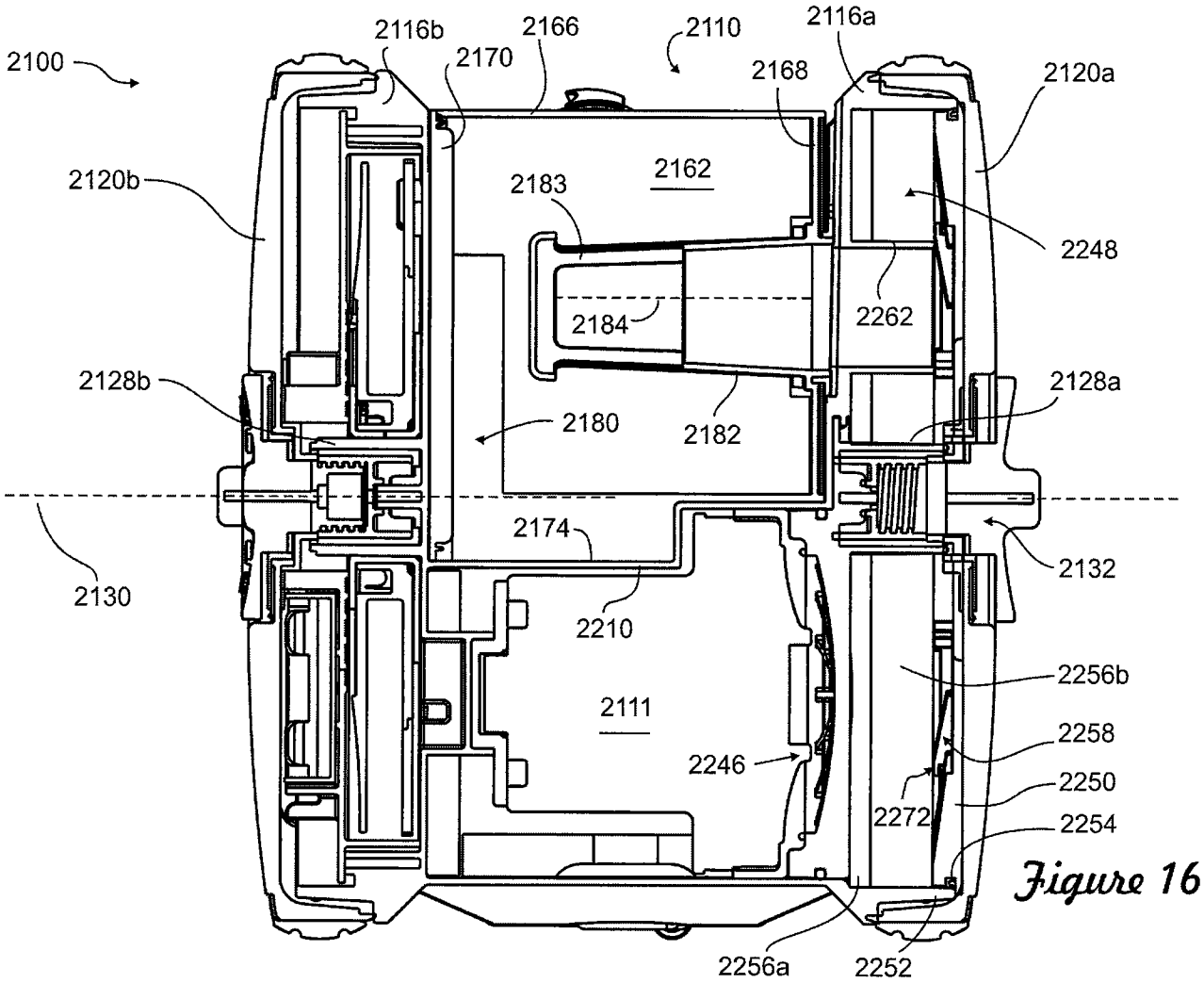
FIG. 16 is a section view taken along line 16-16 in FIG. 11.

In the illustrated example, the body sidewalls 2116*a, b* are generally circular and cover substantially the entire side faces of the surface cleaning apparatus 2100. One main side wheel 2120*a*, 2120*b* is coupled to the outer face of each body sidewall 2116*a* and 2116*b*, respectively. Optionally, the side wheels 2120*a*, 2120*b* may have a larger diameter 2126 than the body sidewalls 2116*a, b* and can completely cover the outer faces of the sidewalls 2116*a, b*. Referring to FIG. 16, each side wheel 2120*a, b* is rotatably supported by a corresponding axel 2128*a*, 2128*b*, which extends from the body sidewalls 2116*a* and 2116*b*, respectively. The main side wheels 2120*a* and 2120*b* are rotatable about a primary axis of rotation 2130. In the illustrated example, the primary axis of rotation 2130 passes through the cyclone bin assembly 2110.

Figure 15:
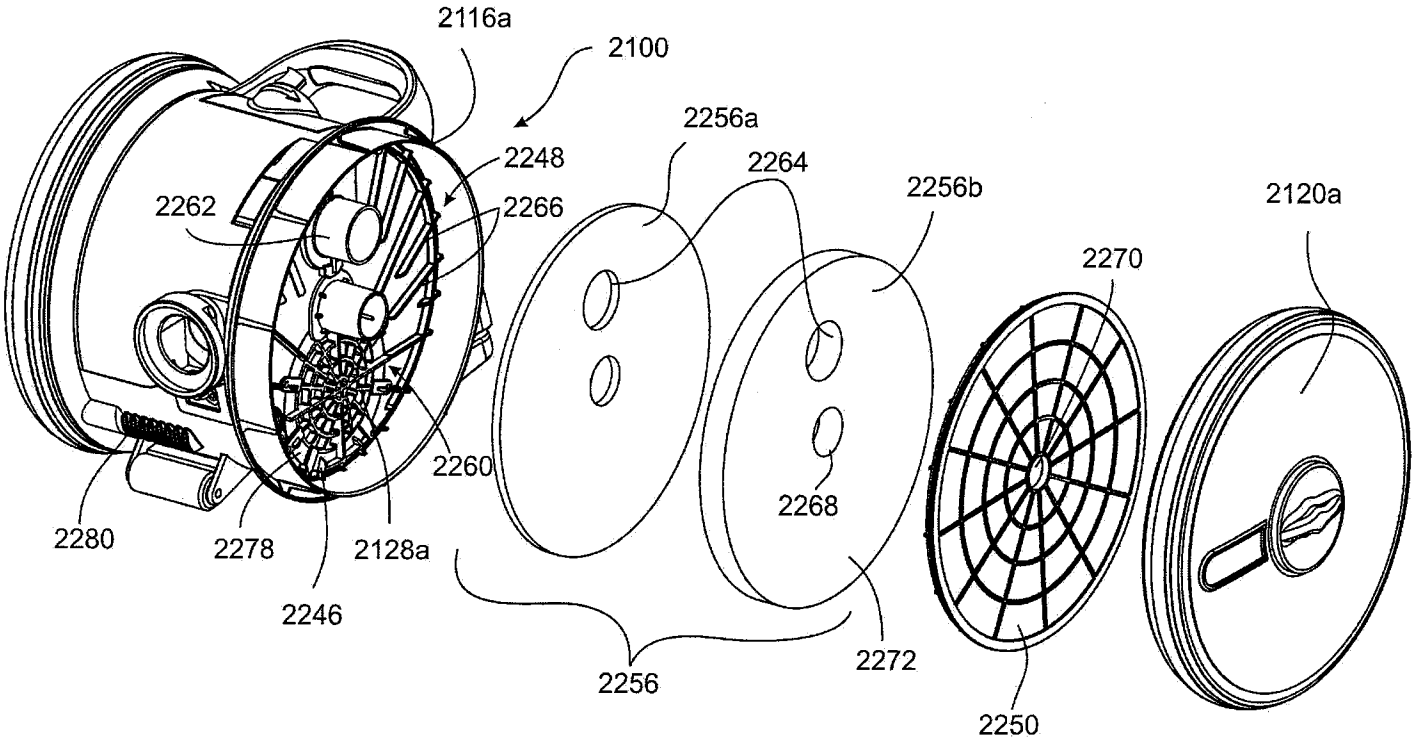
FIG. 15 is a partially exploded view of the surface cleaning apparatus of FIG. 11.

Optionally, at least one of the side wheels 120*a, b* can be detachable from the body 112. Referring to FIG. 15, in the illustrated example side wheel 2120*a* is detachably coupled to its corresponding axels 2128*a* by a threaded hub assembly 2132*a*, and can be removed from the body 2112. Removing the side wheel 2120*a* from the body 112, or otherwise positioning them in an open configuration, may allow a user to access a variety of components located in compartments between the side wheels 120*a* and 120*b* and the corresponding sidewalls 116*a* and 116*b*, as explained in greater detail below.

FIGS. 12, 13, 14 and 16 illustrated an example of a cyclone bin assembly 2110 includes a cyclone chamber 2162 and a dirt collection chamber 2164 in accordance with one embodiment. The cyclone bin assembly 2110 is detachably mounted in the cavity 2118, laterally between the sidewalls 2116*a*, 2116*b* and side wheels 2120*a*, 2120*b*. Positioning the cyclone bin assembly 2110 in the cavity 2118, between the body sidewalls 2116*a*, 2116*b* may help protect the cyclone bin assembly 2110 from side impacts, for example if the surface cleaning apparatus 2100 contacts a piece of furniture or other obstacle. Preferably, the body sidewalls 2116*a*, 2116*b* have a larger cross-sectional area than the cyclone bin assembly 2110. More preferably, the transverse faces of the cyclone bin assembly 2110 are entirely covered by the body sidewalls 2116*a*, 2116*b*.

In the illustrated example, the cyclone chamber 2162 is bounded by a sidewall 2166, a first end wall 2168 and a second end wall 2170. A tangential air inlet 2172 is provided in the sidewall of the cyclone chamber 2162 and is in fluid communication with the dirty air inlet 2102. Air flowing into the cyclone chamber 2162 via the air inlet can circulate around the interior of the cyclone chamber 2162 and dirt particles and other debris can become disentrained from the circulating air.

A slot 2180 formed between the sidewall 2166 and the second end wall 2170 serves as a cyclone dirt outlet 2180. Debris separated from the air flow in the cyclone chamber 2162 can travel from the cyclone chamber 2162, through the dirt outlet 2180 to the dirt collection chamber 2164.

Air can exit the cyclone chamber 2162 via an air outlet. In the illustrated example, the cyclone air outlet includes a vortex finder 2182. Optionally, a removable screen 2183 can be positioned over the vortex finder 2182. The cyclone chamber 2162 extends along a longitudinal cyclone axis 2184. In the example illustrated, the longitudinal cyclone axis is aligned with the orientation of the vortex finder 2182 and is generally transverse to the direction of movement of the surface cleaning apparatus 2100. The cyclone chamber 2162 has a generally circular cross sectional shape (taken in a plane perpendicular to the cyclone axis) and has a cyclone diameter 2186.

The dirt collection chamber 2164 comprises a sidewall 2174, a first end wall 2176 and an opposing second end wall 2178. In the illustrated example, at least a portion of the dirt collection chamber sidewall 2174 is integral with a portion of the cyclone chamber sidewall 2166, and at least a portion of the first cyclone end wall 2168 is integral with a portion of the first dirt collection chamber end wall 2176.

Figure 12:
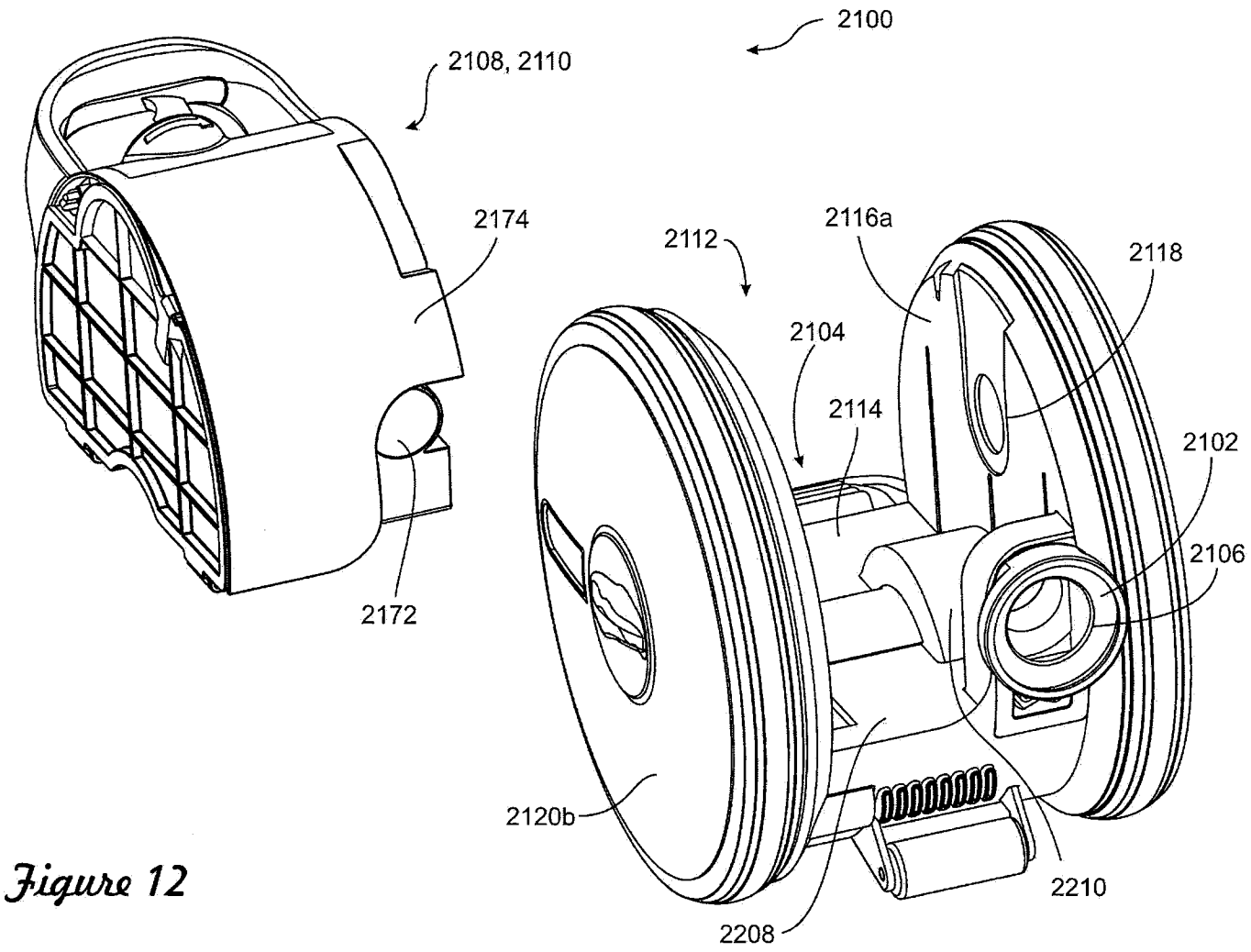
FIG. 12 is a perspective illustration of the surface cleaning apparatus of FIG. 11, with its cyclone bin assembly removed.
Figure 14:
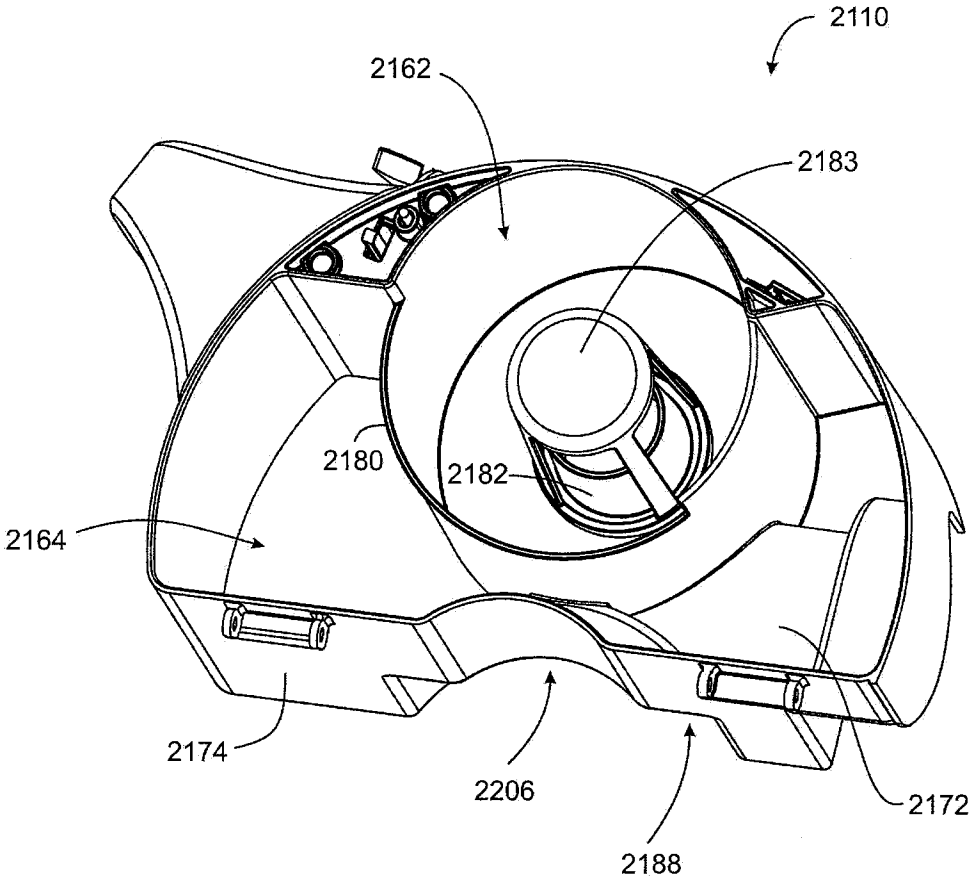
FIG. 14 is a perspective illustration of the cyclone bin assembly of FIG. 13, with the one end wall removed.

Referring to FIGS. 12 and 14, a lower surface 2188 of the cyclone bin assembly 2110 is configured to rest on the platform 2114, and the first and second end walls 2168, 2170 of the cyclone bin assembly 2110 are shaped to engage the inner surfaces of the body sidewalls 2116*a*, 2116*b*, respectively. The upper portion of the cyclone bin (as viewed when installed in the cavity 2118) can have a radius of curvature that generally corresponds to the radius of curvature of the body sidewalls 2116*a*, 2116*b* and the side wheels 2120*a*, 2120*b*. Matching the curvature of the cyclone bin assembly 2110 with the curvature of the side wheels 120*a*, 120*b* may help facilitate mounting of the cyclone bin assembly 2110 within the body 2112, so that the walls of the cyclone bin assembly 2110 do not extend radially beyond the body sidewalls 2116*a*, 1216*b* or main side wheels 2120*a*, 2120*b*.

Figure 13:
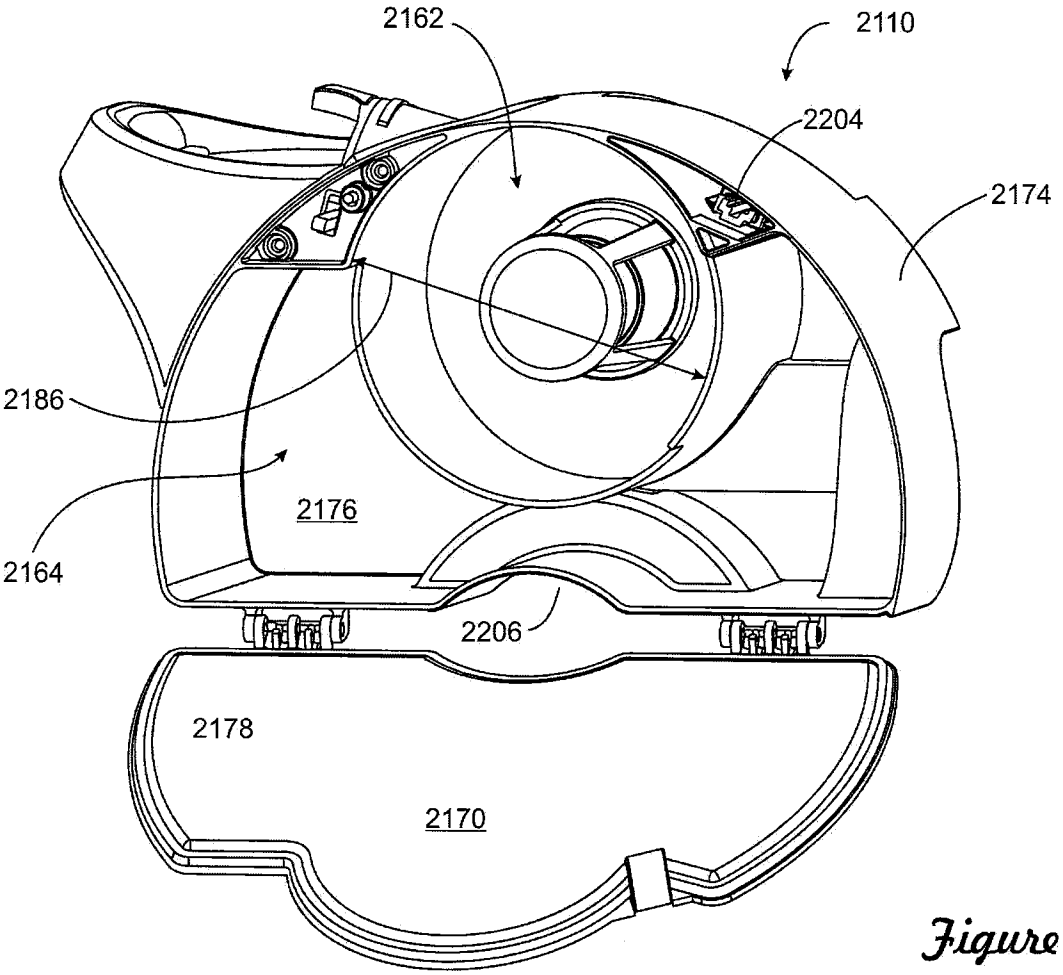
FIG. 13 is a perspective illustration of the cyclone bin assembly of FIG. 12, with one end wall in an open configuration.

Referring to FIG. 13, the second dirt collection chamber end wall 2178 is preferably pivotally connected to the dirt collection chamber sidewall 2174. The second dirt collection chamber end wall 2178 can be opened to empty dirt and debris from the interior of the dirt collection chamber 2164. Optionally, the second cyclone end wall 2170 is integral with and is openable with the second dirt collection chamber end wall 2178. Opening the second cyclone end wall 2170 can allow dirt and debris to be emptied from the cyclone chamber 2162. The second dirt collection chamber sidewall 2178 can be retained in the closed position by a releasable latch 2204. Optionally, the screen 2183 and/or the vortex finder 2182 can be removable from the cyclone chamber 2162 and can be removed when the second dirt collection chamber end wall 2178 is open.

Referring to FIGS. 13 and 14, the dirt collection chamber sidewall 2174 comprises a recess 2206 that is shaped to receive a corresponding portion of the body 2112. Referring to FIG. 12, in the illustrated example, the platform 2114 comprises a generally planar bearing surface 2208 for supporting the cyclone bin assembly 2110. The platform 2114 also comprises at least a portion of the suction motor housing 2210 surrounding the suction motor 2111. In this example, the recess 2206 in the dirt collection chamber sidewall 2174 is shaped to receive the portion of the motor housing 2210 projecting above the planar bearing surface 2208.

Preferably, at least a portion of the dirt collection chamber 2164 surrounds at least a portion of the suction motor 2111 and the suction motor housing 2210. In this example, at least a portion of the dirt collection chamber 2164 is positioned between the cyclone chamber 2162 and the suction motor housing 2210 (and the suction motor 2111 therein). Configuring the dirt collection chamber 2164 to at least partially surround the suction motor housing 2210 may help reduce the overall size of the surface cleaning apparatus 2100, and/or may help increase the capacity of the dirt collection chamber 2164. The dirt collection chamber 2164 also surrounds at least a portion of the cyclone chamber 2162.

Referring to FIGS. 15 and 16, air exiting the cyclone chamber 2162 flows to a suction motor inlet 2246 via a filter chamber 2248. The filter chamber 2248 is provided downstream from the cyclone air outlet. In the illustrated example, the filter chamber 2248 comprises a recessed chamber in the body sidewall 2116*a* that is enclosed by an openable seal plate 2250. A sealing gasket 2254 is provided at the interface between an annular rim 2252 of the sidewall 2116*a* and the seal plate 2250 to help provide an air-tight filter chamber 2248. In the illustrated example, the filter chamber 2248 extends over substantially the entire sidewall

2116*a* and overlies substantially all of the transverse cross sectional area of cyclone chamber 2162, dirt collection chamber 2164 and suction motor 2111.

A pre-motor filter 2256 is provided in the filter chamber 2248 to filter the air before it enters the suction motor inlet. The pre-motor filter 2256 is sized to cover substantially the entire area of the filter chamber 2248, and overlies substantially all of the transverse cross sectional area of the cyclone chamber 2162, dirt collection chamber 2164 and suction motor 2111. In the illustrated example, the pre-motor filter 2256 comprises first and second pre-motor filters 2256*a*, 2256*b*. The filter chamber 2248 comprises an air inlet chamber 2258 on the upstream side of the pre-motor filter 256, and an air outlet chamber 2260 on the downstream side of the pre-motor filter 2256. Air can travel from the air inlet chamber 2258 to the air outlet chamber 2260 by flowing through the pre-motor filter 2256.

The air inlet chamber 2258 is fluidly connected to the vortex finder 2182 by an inlet conduit 2262 that extends through a first aperture 2264 in the pre-motor filter 2256. The air outlet chamber 2260 is in fluid communication with the inlet 2246 of the suction motor 2111. The pre-motor filter 2256 can be supported by a plurality of support ribs 2266 extending from the sidewall 2116*a* into the air outlet chamber 2260. Cutouts can be provided in the ribs to allow air to circulate within the air outlet chamber 2266 and flow toward the suction motor inlet 2246.

In the illustrated example, the axle 2128*a* for supporting the side wheel extends through the air filter chamber 2248, a second aperture 2268 in the pre-motor filter 2256 and through an axel aperture 2270 in the seal plate 2250. The axle aperture 2270 in the seal plate 2250 is configured to provide an air-tight seal against the axel 2128*a*. Optionally, a sealing gasket can be provided at the interface between the seal plate 2250 and the axel 2128*a*. In this configuration the pre-motor filter 2256 surrounds the axel 2128*a*.

In the illustrated example, the seal plate 2250 is removable, when the side wheel 2120*a* is detached, to allow a user to access the pre-motor filter 2256. Alternatively, instead of being removable, the seal plate 2250 can be movably attached to the body 2112, for example pivotally connected to the sidewall 2116*a*, such that the seal plate 2250 can be opened without being completely detached from the body 2112.

Preferably, the seal plate 2250 is transparent, or at least partially transparent. Providing a transparent seal plate 2250 may help facilitate visual inspection of the upstream side 2272 of the pre-motor filter 2256 while the seal plate 2250 is in place. When the seal plate 2250 is removed, the pre-motor filter 2256 may be removed, for example for cleaning or replacement.

A bleed valve is provided to supply clean air to the suction motor inlet. In the illustrated example a bleed valve air outlet 2278 is in fluid communication with the air outlet chamber 2260 and can introduce clean air into the air outlet chamber 2260 downstream from the pre-motor filter 2256. Air introduced by the bleed valve can flow through the cutouts in the supporting ribs 2266, as described above. The bleed valve may be a pressure sensitive valve that is opened when there is a blockage in the air flow path upstream from the suction motor 2111. In the illustrated example, the bleed valve is parallel with the suction motor 2111. A bleed valve inlet 2280 (see also FIG. 11) is provided toward the front of the body 2112.

It will be appreciated that, in one embodiment, the enhanced dirt collection chamber construction may be used by itself without the enhanced filter chamber design. Alternately, both the enhanced dirt collection chamber construction and the enhanced filter chamber design may be used concurrently as exemplified herein. It will also be appreciated that the cyclone chamber may be of any design and configuration. When either of the enhanced dirt collection chamber construction and/or the enhanced filter chamber design are used, the vacuum cleaner may be of any design and the dirt collection chamber may or may not be removably mounted from the vacuum cleaner.

Various apparatuses or methods are described above to provide an example of each claimed invention. No example described above limits any claimed invention and any claimed invention may cover processes or apparatuses that are not described above. The claimed inventions are not limited to apparatuses or processes having all of the features of any one apparatus or process described above or to features common to multiple or all of the apparatuses described above.

The invention claimed is:

1. A hand vacuum cleaner having a front end, a rear end, and comprising:

(a) a main housing;

(b) a dirty fluid inlet;

(c) a cyclone bin assembly comprising a cyclone chamber downstream of the dirty fluid inlet, the cyclone chamber comprising a first end, a second end, a cyclone axis, a cyclone air inlet and a cyclone air outlet wherein the cyclone air outlet is located at the second end;

(d) a pre-motor filter comprising an upstream side and a downstream side, the pre-motor filter is positioned in a pre-motor filter housing having an openable cover, the cyclone axis extends through the pre-motor filter housing;

(e) a suction motor positioned in the main housing and located downstream of the pre-motor filter and rearward of the cyclone bin assembly;

(f) an air flow path extending from the pre-motor filter to the suction motor;

(g) a clean air outlet downstream of the suction motor; and, (h) a handle connected to the hand vacuum cleaner at first and second locations, wherein the first location is at a position of the suction motor in the main housing and a first handle portion is connected at the first location, wherein a projection of the first handle portion extends through the suction motor, wherein the pre-motor filter housing is openable without moving the handle with respect to the cyclone chamber, and wherein the pre-motor filter housing cover is openable while the cyclone bin assembly is in fluid flow communication with the suction motor.

2. The hand vacuum cleaner of claim 1 wherein the suction motor comprises a fan and a motor and an upstream side of the fan is positioned proximate the cyclone inlet.

3. The hand vacuum cleaner of claim 1 wherein the downstream side of the pre-motor filter is spaced further from the cyclone chamber than the upstream side of the pre-motor filter.

4. The hand vacuum cleaner of claim 3 further comprising a downstream header on the downstream side of the pre-motor filter and the downstream header is opened when the openable cover is opened.

5. The hand vacuum cleaner of claim 1 wherein the upstream side of the pre-motor filter is spaced further from the cyclone chamber than the downstream side of the pre-motor filter.

6. The hand vacuum cleaner of claim 5 further comprising a conduit that is in flow communication with the air outlet of the cyclone chamber and extends through the pre-motor filter.

7. The hand vacuum cleaner of claim 5 further comprising an upstream header on the upstream side of the pre-motor filter and the upstream header is opened when the openable cover is opened.

8. The hand vacuum cleaner of claim 1 wherein each of the upstream and downstream sides of the pre-motor filter has a front end positioned proximate the front end and extending rearwardly, the pre-motor filter is positioned axially outwardly from the second end of the cyclone chamber and downstream of the cyclone chamber, the cyclone air outlet is positioned at a location spaced from the front end of the pre-motor filter.

9. The hand vacuum cleaner of claim 1 wherein the pre-motor filter is positioned axially outwardly from the second end of the cyclone chamber and downstream of the cyclone chamber, the pre-motor filter overlies at least a portion of the second end of the cyclone chamber.

10. The hand vacuum cleaner of claim 1 wherein the suction motor has a suction motor axis and when the hand vacuum cleaner is carried by the handle, the suction motor axis extends generally horizontally.

11. The hand vacuum cleaner of claim 10 wherein when the hand vacuum cleaner is carried by the handle, the cyclone axis extends generally horizontally.

12. The hand vacuum cleaner of claim 1 wherein when the hand vacuum cleaner is carried by the handle, the cyclone axis extends generally horizontally.

13. The hand vacuum cleaner of claim 1 wherein the pre-motor filter comprises a physical filter media.

14. A hand vacuum cleaner having a front end, a rear end and comprising:

(a) a main housing;

(b) a dirty fluid inlet;

(c) a cyclone bin assembly comprising a cyclone chamber downstream of the dirty fluid inlet, the cyclone chamber comprising a first end, a second end, a cyclone air inlet, a cyclone axis, and a cyclone air outlet that is located at the second end;

(d) a pre-motor filter comprising an upstream side and a downstream side, the pre-motor filter is positioned in a pre-motor filter housing having an openable cover;

(e) a suction motor positioned in the main housing and located downstream of the pre-motor filter and rearward of the cyclone bin assembly;

(f) an air flow path extending from the pre-motor filter to the suction motor;

(g) a clean air outlet downstream of the suction motor; and, (h) a handle connected to the hand vacuum cleaner at first and second locations wherein the first location is at a position of the suction motor in the main housing, the handle has a first handle portion provided at the first location, a projection of the first handle portion extends through the suction motor, and the pre-motor filter housing is openable without moving the handle with respect to the cyclone chamber;

wherein the pre-motor filter housing cover is openable while the cyclone chamber is in fluid flow communication with the suction motor, and wherein the first and second locations are provided other than on the openable pre-motor filter housing cover.

15. The hand vacuum cleaner of claim 14 wherein the suction motor comprises a fan and a motor and an upstream side of the fan is positioned proximate the cyclone air inlet.

16. The hand vacuum cleaner of claim 14 wherein the downstream side of the pre-motor filter is spaced further from the cyclone chamber than the upstream side of the pre-motor filter.

17. The hand vacuum cleaner of claim 14 further comprising a downstream header on the downstream side of the pre-motor filter and the downstream header is opened when the openable cover is opened.

18. The hand vacuum cleaner of claim 14 wherein the upstream side of the pre-motor filter is spaced further from the cyclone chamber than the downstream side of the pre-motor filter.

19. The hand vacuum cleaner of claim 18 further comprising a conduit that is in flow communication with the cyclone air outlet and extends through the pre-motor filter.

20. The hand vacuum cleaner of claim 18 further comprising an upstream header on the upstream side of the pre-motor filter and the upstream header is opened when the openable cover is opened.

21. The hand vacuum cleaner of claim 14 wherein each of the upstream and downstream sides of the pre-motor filter has a front end positioned proximate the front end and extending rearwardly, the pre-motor filter is positioned axially outwardly from the second end of the cyclone chamber and downstream of the cyclone chamber, the cyclone air outlet is positioned at a location spaced from the front end of the pre-motor filter.

22. The hand vacuum cleaner of claim 14 wherein the suction motor has a suction motor axis and when the hand vacuum cleaner is carried by the handle, the suction motor axis extends generally horizontally.

23. The hand vacuum cleaner of claim 22 wherein when the hand vacuum cleaner is carried by the handle, the cyclone axis extends generally horizontally.

24. The hand vacuum cleaner of claim 14 wherein when the hand vacuum cleaner is carried by the handle, the cyclone axis extends generally horizontally.

25. The hand vacuum cleaner of claim 14 wherein the pre-motor filter comprises a physical filter media.

* * * * *